US011136769B2

(12) United States Patent
Zitting et al.

(10) Patent No.: US 11,136,769 B2
(45) Date of Patent: Oct. 5, 2021

(54) SYSTEM AND METHOD FOR AUTOMATING VERTICAL SLIP FORMING IN CONCRETE CONSTRUCTION

(71) Applicants: James Zitting, Humansville, MO (US); Ethan Zitting, Humansville, UT (US)

(72) Inventors: James Zitting, Humansville, MO (US); Ethan Zitting, Humansville, UT (US)

( * ) Notice: Subject to any disclaimer, the term of this patent is extended or adjusted under 35 U.S.C. 154(b) by 345 days.

(21) Appl. No.: 15/997,582

(22) Filed: Jun. 4, 2018

(65) Prior Publication Data

US 2018/0347211 A1 Dec. 6, 2018

Related U.S. Application Data

(60) Provisional application No. 62/514,145, filed on Jun. 2, 2017.

(51) Int. Cl.

| | |
|---|---|
| ***E04G 11/24*** | (2006.01) |
| ***E04G 21/04*** | (2006.01) |
| ***E04G 21/16*** | (2006.01) |
| ***E04G 11/22*** | (2006.01) |

(52) U.S. Cl.

CPC ..... *E04G 11/24* (2013.01); *E04G 11/22* (2013.01); *E04G 21/0418* (2013.01); *E04G 21/16* (2013.01)

(58) Field of Classification Search

CPC ..... E04G 11/20; E04G 11/22; E04G 11/24; E04G 11/28; E04G 21/0418; E04G 21/16

See application file for complete search history.

(56) References Cited

U.S. PATENT DOCUMENTS

| | | | | | |
|---|---|---|---|---|---|
| 802,699 | A * | 10/1905 | Lancaster | E04G 11/22 | 425/63 |
| 1,165,586 | A * | 12/1915 | Fraser etal. | E04G 11/22 | 425/63 |
| 1,376,911 | A * | 5/1921 | Abram | E04G 11/20 | 425/64 |
| 1,464,600 | A * | 8/1923 | Dunham | E04G 11/22 | 425/63 |
| 1,596,605 | A * | 8/1926 | Evans | E04G 11/22 | 52/742.14 |
| 2,217,115 | A * | 10/1940 | Hermodsson | E04G 11/22 | 52/745.05 |

(Continued)

FOREIGN PATENT DOCUMENTS

| | | | | |
|---|---|---|---|---|
| CA | 3020211 A1 * | 10/2017 | ..... | E04G 11/28 |
| DE | 3703487 A1 * | 8/1988 | ..... | E04G 11/28 |

(Continued)

*Primary Examiner* — Michael Safavi

(74) *Attorney, Agent, or Firm* — Gurr Brande & Spendlove, PLLC; Robert A. Gurr

(57) ABSTRACT

A system for forming a vertical structure through the incremental pouring of wet concrete has a plurality of vertical columns external to the concrete of the vertical structure; a slip form structure comprising a pair of opposing walls forming a bottomless trough; a main frame coupled to the slip form structure, wherein the main frame is supported on, and configured to move vertically along, the vertical columns; and a work platform residing below the slip form structure and main frame, the work platform being supported on, and configured to move vertically along, the vertical columns; wherein the main platform moves independently of the work platform.

15 Claims, 32 Drawing Sheets

(56) References Cited

U.S. PATENT DOCUMENTS 2,516,318 A * 7/1950 Hawes ..... E04G 11/24 425/63
2,596,854 A * 5/1952 Jack ..... E04G 11/24 425/65
3,207,263 A 9/1965 Cull
3,224,065 A 12/1965 Cheskin
3,510,098 A * 5/1970 Fox ..... E04G 11/065 249/20
3,516,129 A * 6/1970 Yoder ..... E04G 11/22 425/64
3,973,885 A * 8/1976 Schmidt ..... E04G 11/24 425/65
4,128,610 A * 12/1978 Ahlgren ..... E04G 11/22 249/20
4,374,790 A 2/1983 McGowan
5,490,367 A 2/1996 Lee
6,260,311 B1 * 7/2001 Vladikovic ..... E04G 11/28 249/20
6,276,912 B1 * 8/2001 Rock ..... E04G 11/28 249/20
2003/0033772 A1 2/2003 Russell
2011/0171336 A1 7/2011 Schwoerer
2017/0016244 A1 1/2017 Keller et al.

FOREIGN PATENT DOCUMENTS

GB 15910 A * 7/1915 ..... E04G 11/22
GB 233796 A * 5/1925 ..... E04G 11/22
GB 517076 A * 1/1940 ..... E04G 11/22
GB 642362 A * 8/1950 ..... E04G 11/22
GB 2099789 A 12/1982
WO WO-2005042876 A1 * 5/2005 ..... E04G 11/24
WO WO-2017136911 A1 * 8/2017 ..... E04G 11/22
WO WO-2019241257 A1 * 12/2019 ..... E04G 17/002

* cited by examiner

SYSTEM AND METHOD FOR AUTOMATING VERTICAL SLIP FORMING IN CONCRETE CONSTRUCTION

CROSS-REFERENCE TO RELATED APPLICATIONS

This application claims the benefit of U.S. Provisional Application Ser. No. 62/514,145, filed on Jun. 2, 2017, which is incorporated herein by reference.

TECHNICAL FIELD

The present invention relates to the field of multi-layered concrete structures formed by a process known as "slip forming." More particularly, the present invention relates to a system and method of automating vertical slip forming.

BACKGROUND

This section is intended to introduce various aspects of the art, which may be associated with exemplary embodiments of the present disclosure. This discussion is believed to assist in providing a framework to facilitate a better understanding of particular aspects of the present disclosure. Accordingly, it should be understood that this section should be read in this light, and not necessarily as admissions of prior art.

Slip forming (also referred to as slip form construction and continuously formed or poured concrete construction) is a method of building concrete structures such as grain silos, nuclear power silos, elevator towers, stairwells, wind turbine towers, and others.

In constructing such towers, wet concrete is poured into forms. As the poured concrete sets, the forms are moved vertically (e.g., using hydraulics or similar means), with the forms "slipping" on the previously-poured concrete. In other words, the forms move vertically at a rate that allows the poured concrete to sufficiently set so as to support a new layer of concrete above, but that is still wet enough, or workable, to allow the new layer of concrete to combine with the previous layer without forming a joint. The overall process may be duplicated until the tower has reached its desired height. In some cases, the desired height may be over 100 feet high.

Despite the advances in the art, several limitations exist. For example, most slip forms and work platforms are supported using rods placed within the concrete, with a work platform surrounding the outside of the poured concrete. Additionally, the assembly is hydraulically raised, with the slip forms and work platforms raising simultaneously. Further, workers must continuously, and manually, pour concrete into the slip forms. Accordingly, there is a need for a system and method of slip forming that does not require framework support rods within the concrete, that may be mechanically raised, and that does not require manual pouring of concrete. The present invention seeks to solve these and other problems.

SUMMARY OF EXAMPLE EMBODIMENTS

In one embodiment, a system for forming a vertical structure through the incremental pouring of wet concrete comprises a plurality of vertical columns external to the concrete of the vertical structure; a slip form structure comprising a pair of opposing walls forming a bottomless trough; a main frame coupled to the slip form structure, wherein the main frame is supported on, and configured to move vertically along, the vertical columns; and a work platform residing below the slip form structure and main frame, the work platform being supported on, and configured to move vertically along, the vertical columns; wherein the main platform moves independently of the work platform.

In one embodiment, the main frame further comprises a plurality of main frame motors coupled thereto; and, a series of geared vertical columns configured to interact with pinions of the respective main frame motors, wherein activation of the main frame motors induces the main frame, and slip form structure coupled thereto, to move vertically along the geared vertical columns such that the main frame and slip form structure are maintained in a substantially horizontal orientation.

In one embodiment, system for forming a vertical structure through the incremental pouring of wet concrete comprises a conduit having a proximal end and a distal end, wherein the proximal end is configured to be placed in fluid communication with a pump for pumping a concrete slurry. The distal end is configured to deliver wet concrete slurry to the trough formed by slip form sections.

The conduit also includes a nozzle at the distal end. The nozzle is configured to deliver a wet concrete slurry into the slip form sections. Optionally, a micro-motor is placed adjacent the nozzle. The micro-motor is configured to generate vibratory energy while concrete slurry is passing through the nozzle.

The system may further include a series of swivels. The swivels are placed along the conduit, and are configured to permit the conduit to articulate along an [x, y] coordinate according to processor commands.

In one embodiment, the system additionally comprises a distance sensor (e.g., IR sensors, optical sensors, ultrasonic, or similar sensors known in the art of distance measuring). The distance sensor resides adjacent the nozzle. The sensor is configured to sense a distance between the sensor and a layer of wet concrete as the wet concrete is poured through the nozzle.

The system may also have a processor. The processor is configured to receive commands from the distance sensor and to cause (i) the nozzle to close, or (ii) a pump to discontinue pumping a concrete slurry into the series of pipe sections, when the distance sensor senses that a layer of wet concrete within a slip form section has reached a designated distance from the nozzle.

In one embodiment, the system comprises a canopy above the slip form sections.

In one embodiment, the system additionally includes a series of base plates. The plurality of base plates are affixed to a foundation of the vertical structure to be formed. Each of the base plates is configured to support a corresponding geared vertical column.

The system also offers a series of brackets. The brackets connect the main frame to selected flanges of the slip form sections. In this way, when the main frame is raised, the slip form structure is raised with it.

Preferably, the system further comprises a work platform. The work platform resides within the geometry formed by the slip form structure and below the main frame. The work platform also comprises a plurality of perimeter members connected together to form a structure within the geometry of the slip form structure.

The work platform is configured to be raised along with the main frame. The work platform may operate with a series of work platform motors, such that the series of geared vertical columns are also configured to interact with respective work platform motors. In this way, the simultaneous activation of the work platform motors induces the work platform to move vertically along the geared vertical columns below the main frame such that the work platform is also maintained in a substantially horizontal orientation.

A method of forming a vertical structure through the incremental pouring of wet concrete is provided.

Also, a method of controlling a conduit associated with a concrete delivery system is provided.

Also, a method of automatically raising slip form sections during a concrete tower construction is provided.

Further, a method of filling a trough associated with a slip form structure is provided.

Additionally, a method of operating a wet concrete slurry delivery system is provided.

Each of these methods may operate under the control of a processor associated with a concrete pouring control system. The processor is programmed to (i) control a rate at which concrete is poured into the trough of a slip form structure in response to depth sensor readings, (ii) close a valve or open a valve associated with a nozzle at the end of a concrete conduit, (iii) move the nozzle along the trough and avoid obstacles, (iv) raise a main frame operatively connected to the slip form structure in response to successive layers of wet concrete being poured, (v) raise a work platform below the main frame, and (vi) combinations thereof. It will be appreciated that while a "processor" is described herein, a microcontroller or similar device may likewise be used.

BRIEF DESCRIPTION OF THE DRAWINGS

So that the manner in which the present inventions can be better understood, certain illustrations, photographs, charts and/or flow charts are appended hereto. It is to be noted, however, that the drawings illustrate only selected embodiments of the inventions and are therefore not to be considered limiting of scope, for the inventions may admit to other equally effective embodiments and applications.

DETAILED DESCRIPTION OF EXAMPLE EMBODIMENTS

Figure 1:
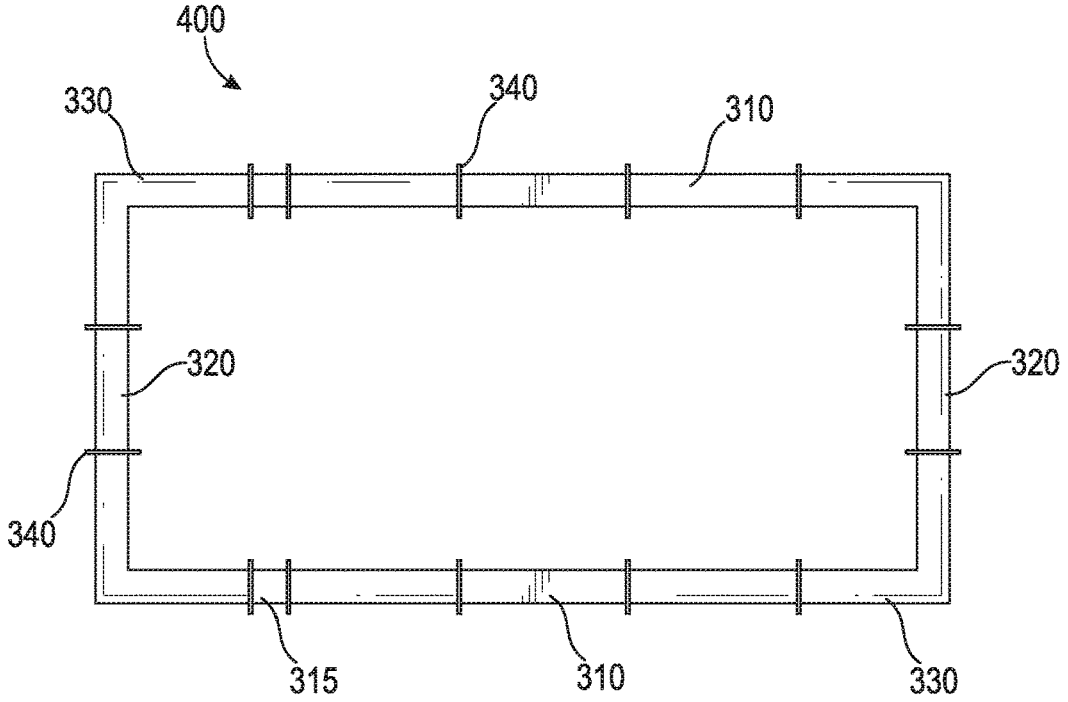
FIG. 1 is a top plan view of an assembled slip form structure.

The following descriptions depict only example embodiments and are not to be considered limiting in scope. Any reference herein to "the invention" is not intended to restrict or limit the invention to exact features or steps of any one or more of the exemplary embodiments disclosed in the present specification. References to "one embodiment," "an embodiment," "various embodiments," and the like, may indicate that the embodiment(s) so described may include a particular feature, structure, or characteristic, but not every embodiment necessarily includes the particular feature, structure, or characteristic. Further, repeated use of the phrase "in one embodiment," or "in an embodiment," do not necessarily refer to the same embodiment, although they may.

Reference to the drawings is done throughout the disclosure using various numbers. The numbers used are for the convenience of the drafter only and the absence of numbers in an apparent sequence should not be considered limiting and does not imply that additional parts of that particular embodiment exist. Numbering patterns from one embodiment to the other need not imply that each embodiment has similar parts, although it may.

Accordingly, the particular arrangements disclosed are meant to be illustrative only and not limiting as to the scope of the invention, which is to be given the full breadth of the appended claims and any and all equivalents thereof. Although specific terms are employed herein, they are used in a generic and descriptive sense only and not for purposes of limitation. Unless otherwise expressly defined herein, such terms are intended to be given their broad, ordinary, and customary meaning not inconsistent with that applicable in the relevant industry and without restriction to any specific embodiment hereinafter described. As used herein, the article "a" is intended to include one or more items. When used herein to join a list of items, the term "or" denotes at least one of the items, but does not exclude a plurality of items of the list. For exemplary methods or processes, the sequence and/or arrangement of steps described herein are illustrative and not restrictive.

It should be understood that the steps of any such processes or methods are not limited to being carried out in any particular sequence, arrangement, or with any particular graphics or interface. Indeed, the steps of the disclosed processes or methods generally may be carried out in various sequences and arrangements while still falling within the scope of the present invention.

The term "coupled" may mean that two or more elements are in direct physical contact. However, "coupled" may also mean that two or more elements are not in direct contact with each other, but yet still cooperate or interact with each other.

The terms "comprising," "including," "having," and the like, as used with respect to embodiments, are synonymous, and are generally intended as "open" terms (e.g., the term "including" should be interpreted as "including, but not limited to," the term "having" should be interpreted as "having at least," the term "includes" should be interpreted as "includes, but is not limited to," etc.).

As previously discussed, there is a need for a system and method of slip forming that does not require framework support rods within the concrete, that may be mechanically raised, and that does not require manual pouring of concrete. The system for forming a vertical structure through the incremental pouring of wet concrete (also referred to as a system for automating vertical slip forming in concrete construction) shown and described herein solves these needs and others.

Figure 2:
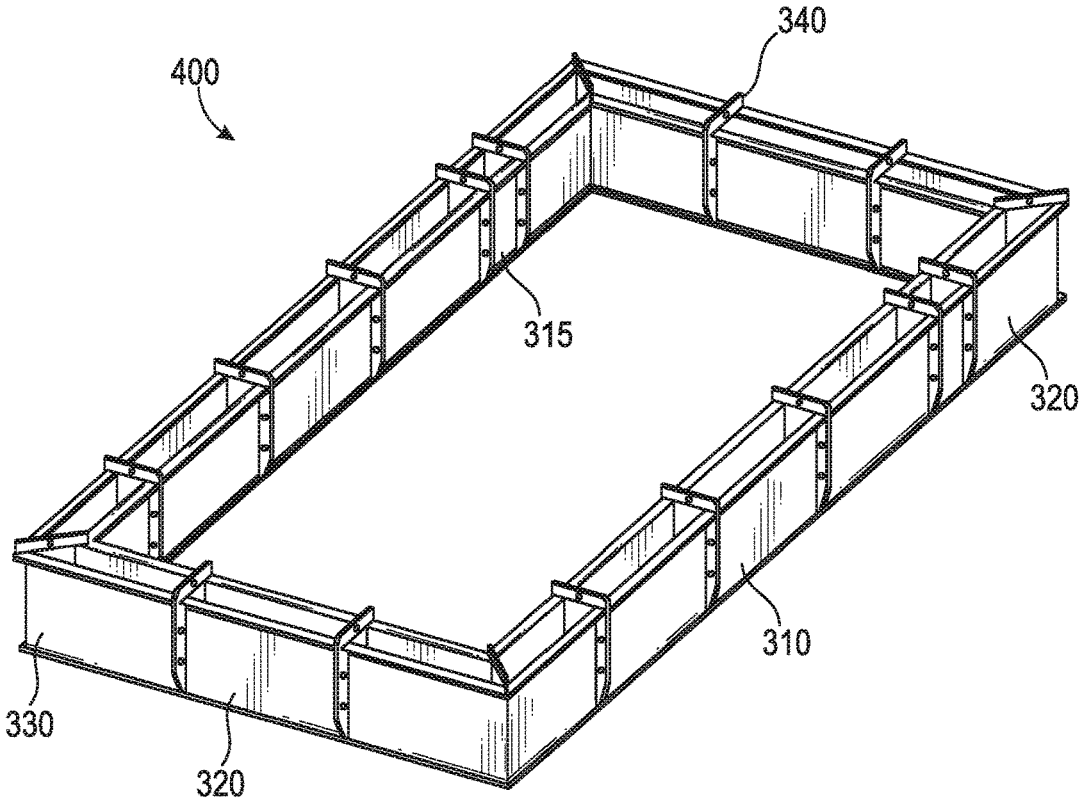
FIG. 2 is a perspective view of an assembled slip form structure.

Referring to FIGS. 1-2, in one embodiment, a system for forming a vertical structure through the incremental pouring of wet concrete comprises a slip form structure 400. The slip form structure 400 represents a polygonal structure having four sides, though other geometries may be used. Preferably, the structure 400 is fabricated from steel, though other metal or rigid plastic materials may be employed.

The slip form structure 400 is fabricated from a plurality of slip form sections. Each slip form section is configured to receive wet concrete in incremental layers. The slip form structure 400 includes side slip form sections 310 and end slip form sections 320. The slip form structure 400 also includes corner sections 330. These sections 310, 320, 330 are removably joined end-to-end using bolts or equivalent means.

In some instances, the geometry of the slip form structure 400 may call for unique or "custom fit" sizes of sections. Illustrative custom slip form sections 315 are also shown in FIGS. 1-2.

Each slip form section 310, 315, 320, 330 includes a flanged end. The flanges 340 flare out from opposing sides (shown best in FIGS. 3-5). The flanges 340 have matching profiles so that adjoining slip form sections 310, 315, 320, 330 may be quickly connected and disconnected using bolts and nuts. Of course, other connection members such as clamps may be employed.

Figure 3:
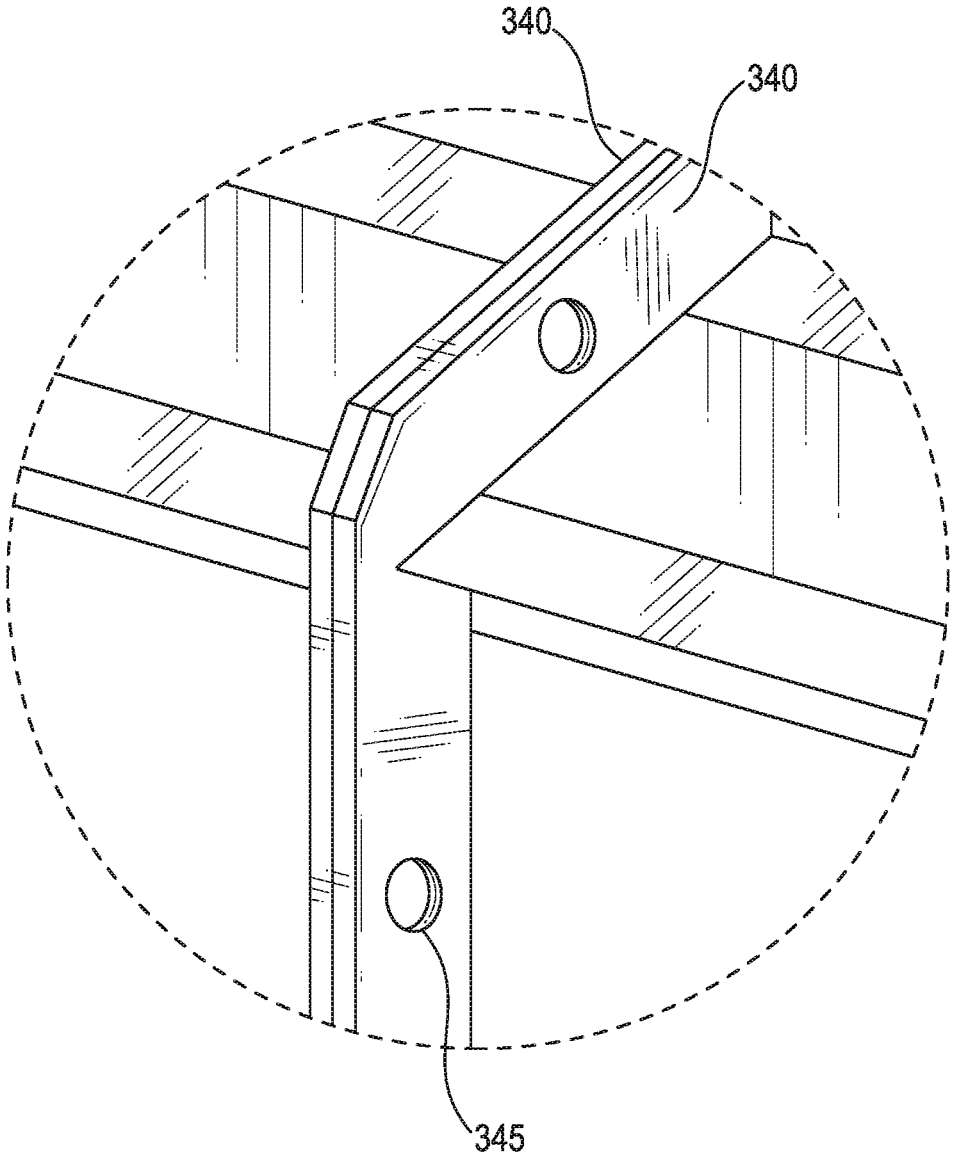
FIG. 3 is a detailed view of flanges of slip form sections.

FIG. 3 is an enlarged view of a portion of two slip form sections, wherein end flanges 340 of adjacent sections are joined. Bolt holes 345 placed along the flanges 340 are aligned, ready to receive a bolt (not shown).

The slip form sections 310, 315, 320, 330 and their associated flanges 340 are preferably fabricated from steel. However, other durable materials such as aluminum or plastic may also be employed.

Figure 4:
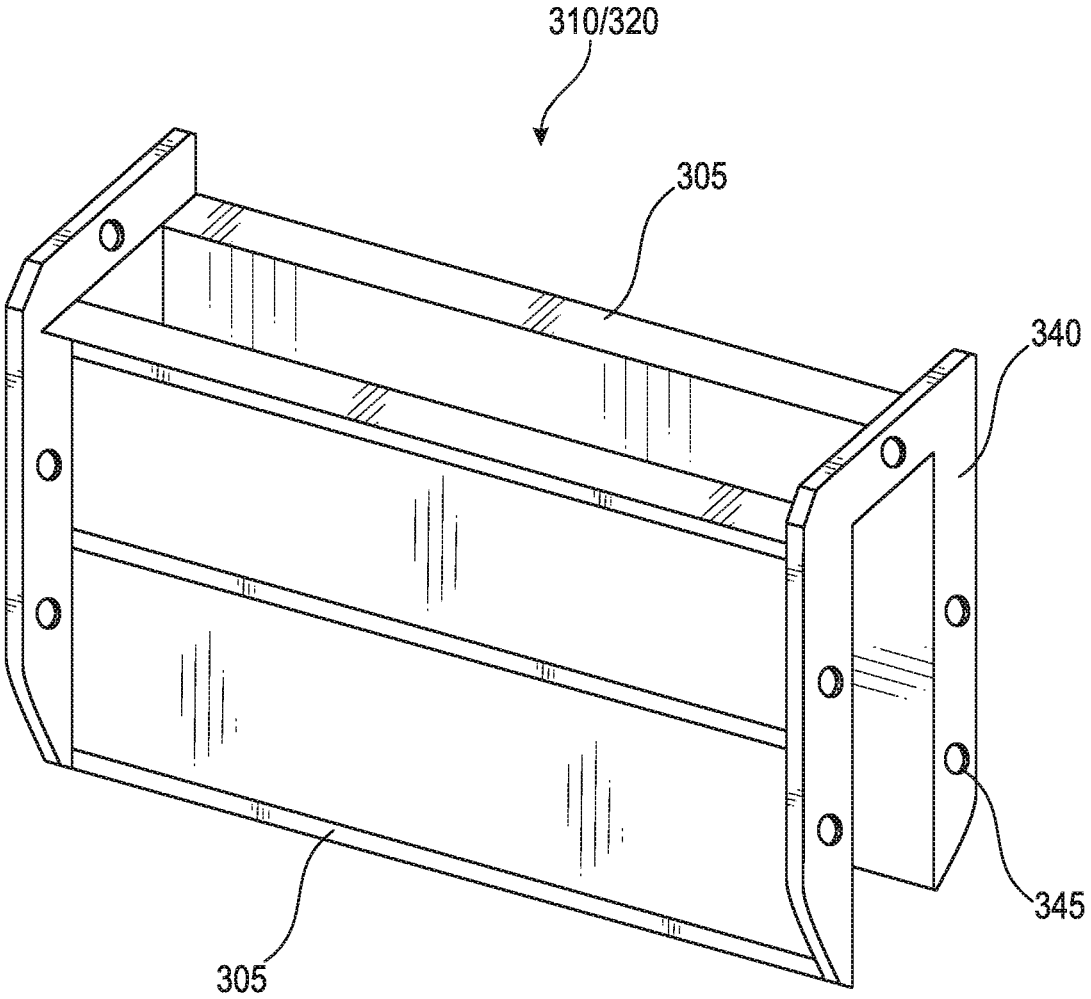
FIG. 4 is a perspective view of a slip form section.

FIG. 4 is a perspective view of the slip form section 310 or 320 of FIG. 2. It can be seen that two opposing sides 305 of the slip form section 310/320 form an open interior. In addition, the opposing flanges 340 form open ends.

Figure 5:
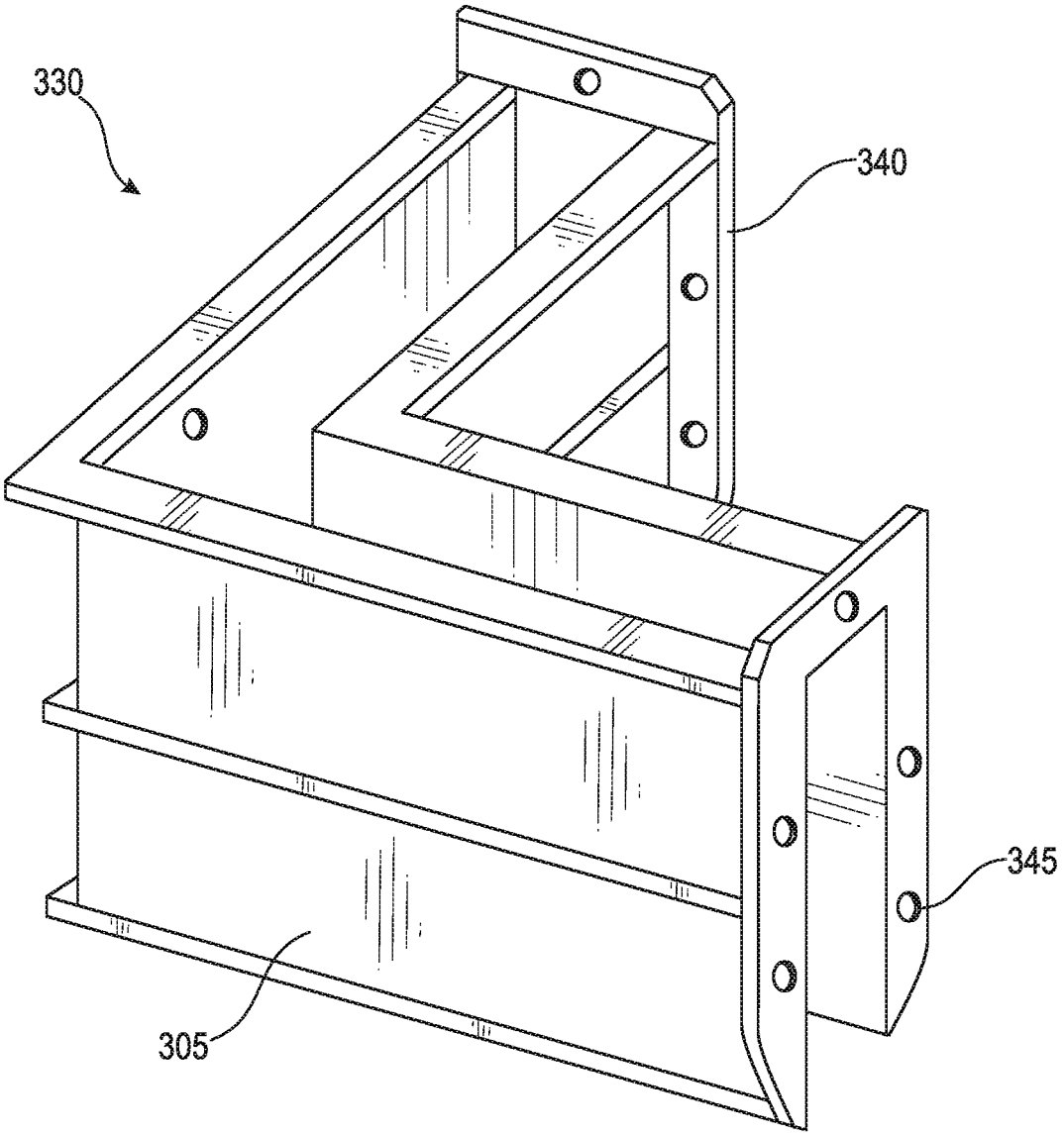
FIG. 5 is a perspective view of a corner slip form section.

FIG. 5 is a perspective view of one of the corner slip form sections 330 of FIG. 2. This corner section forms a right angle. Flanges 340 are again seen at opposing ends of the slip form section 330, which each flange 340 having bolt openings 345. Opposing side walls 305 form an open trough for receiving wet concrete.

Figure 6:
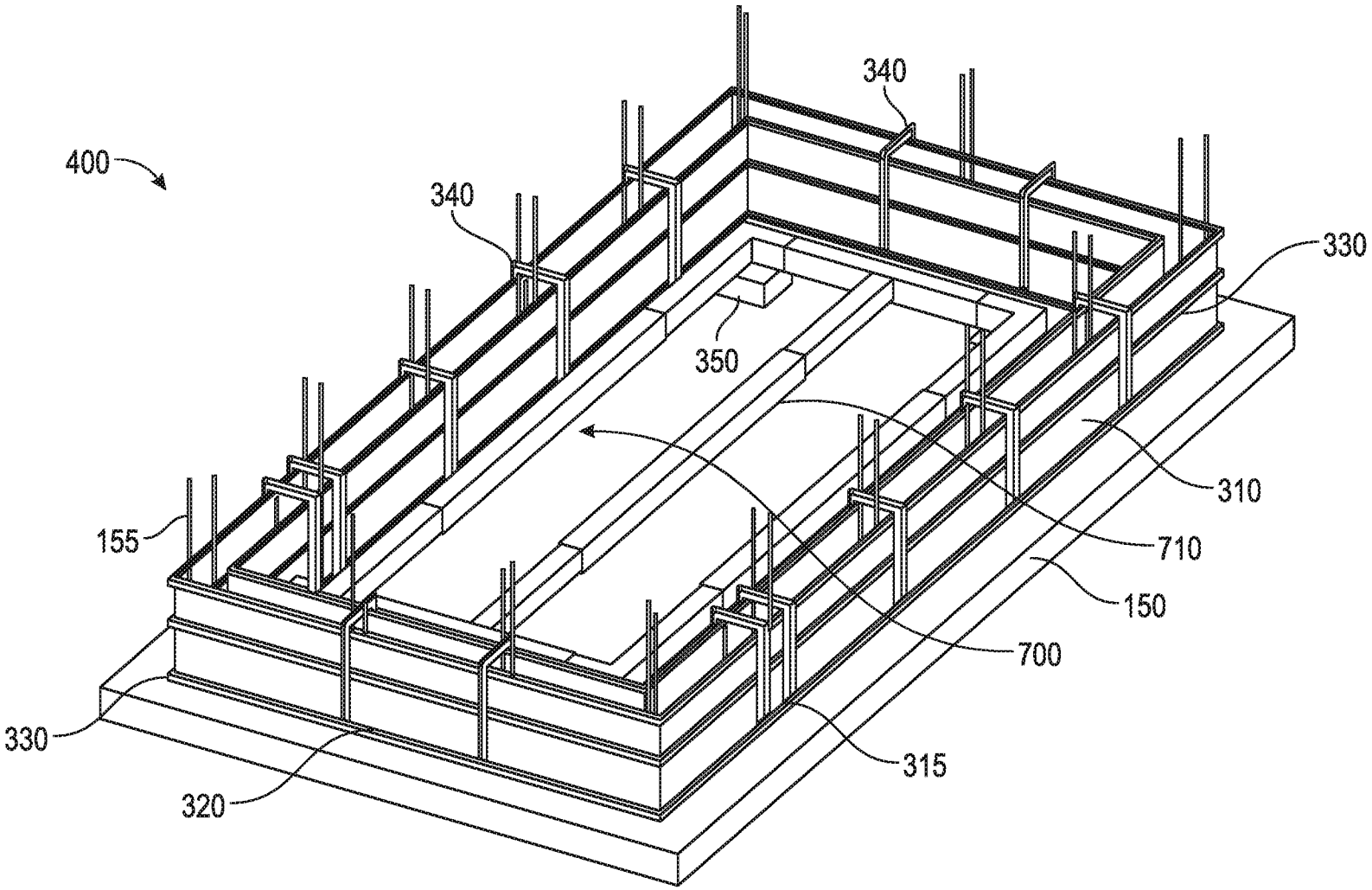
FIG. 6 is a perspective view of an assembled slip form structure and work platform therein on a slab foundation.

FIG. 6 is a perspective view of a concrete foundation 150 having a work platform 700 placed within the geometry of the slip form structure 400. In one embodiment, the work platform 700 is temporarily rested on four base plates 350.

Figure 30:
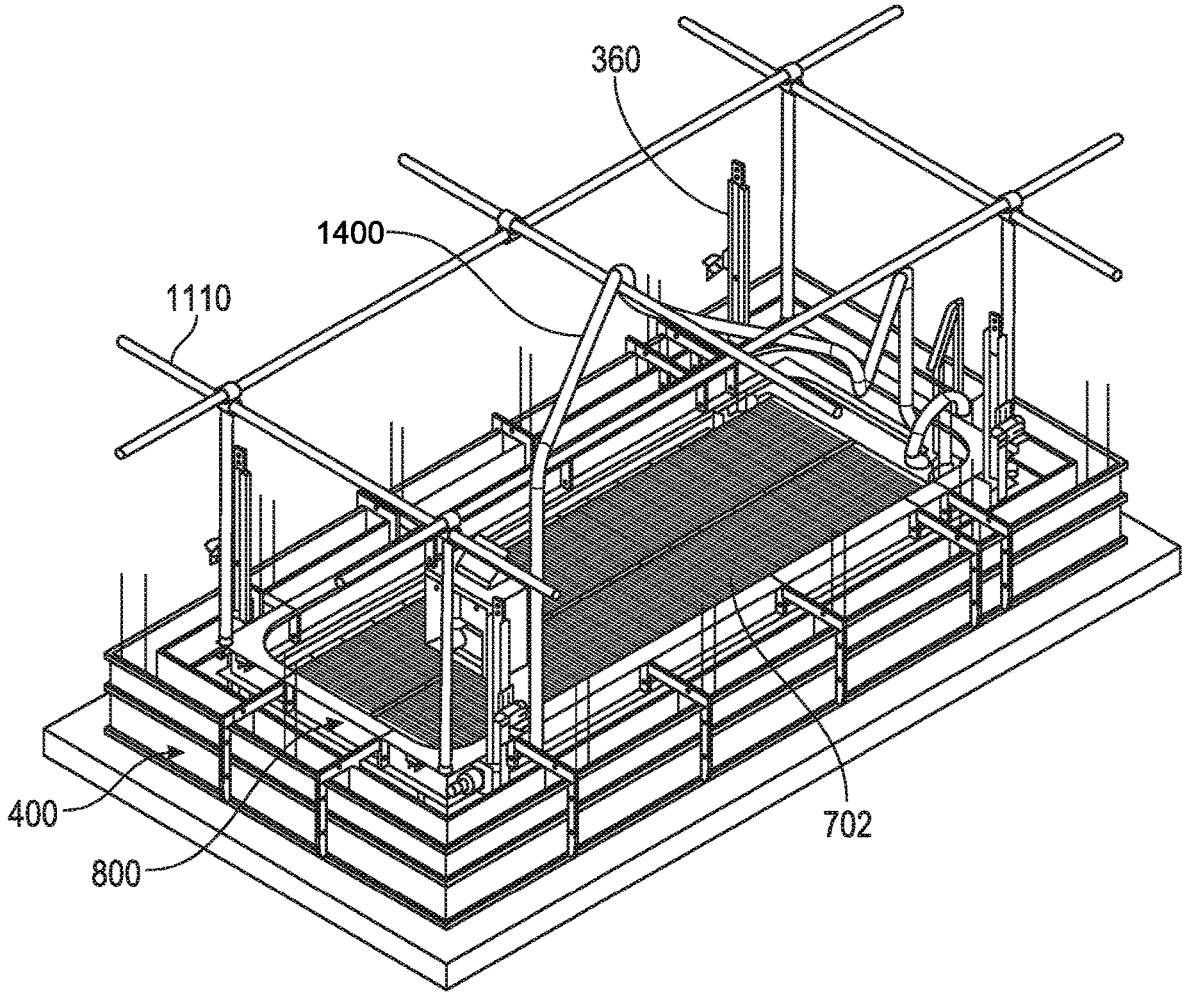
FIG. 30 is a top perspective view of a system for forming a vertical structure through the incremental pouring of wet concrete.
Figure 31:
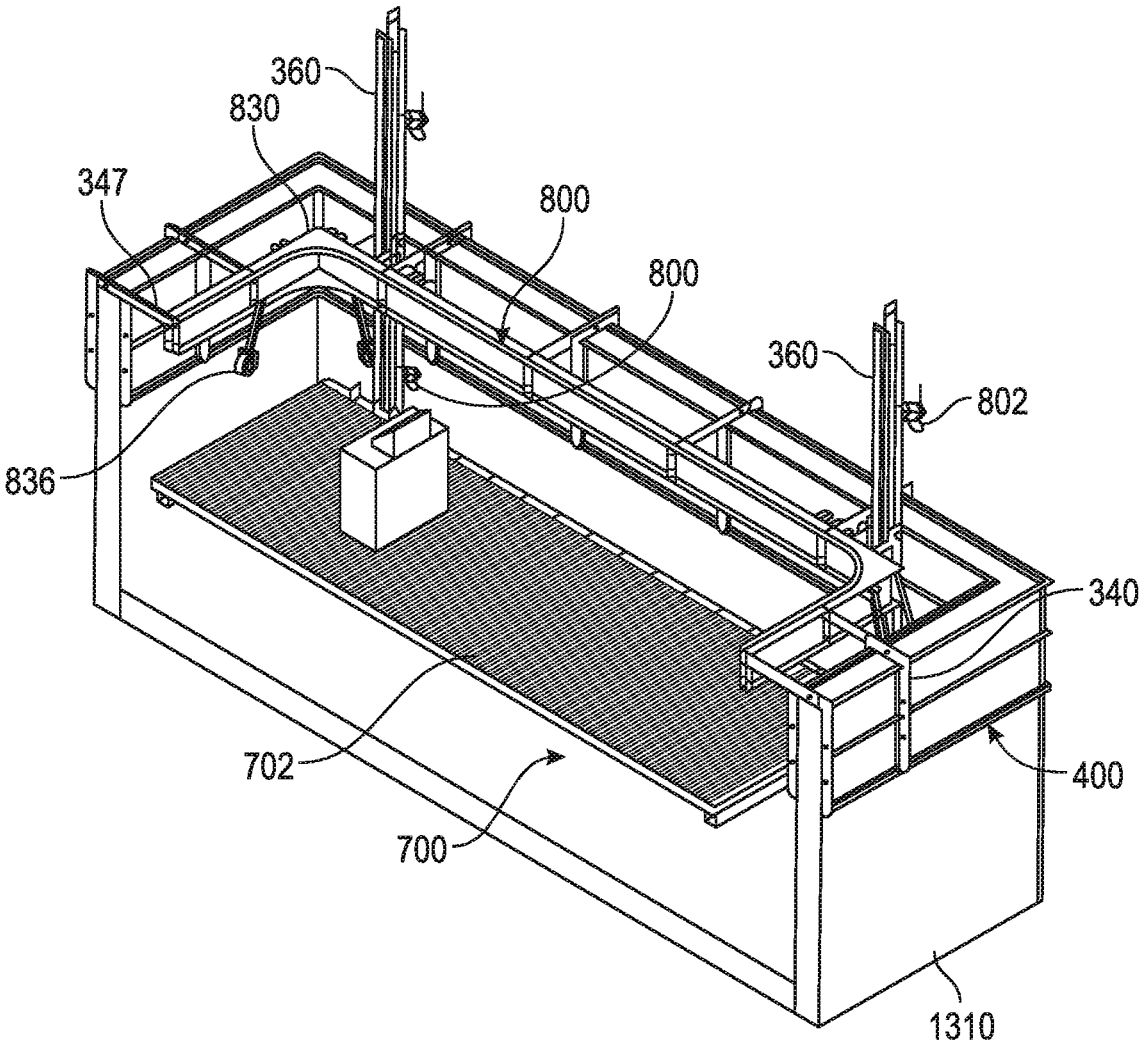
FIG. 31 is a cross-sectional view of a system for forming a vertical structure through the incremental pouring of wet concrete.

The work platform 700 is fabricated from perimeter members 710, which may be tubular, telescoping members, I-beams, or other structural support beam. The perimeter members 710 are preferably fabricated from aluminum, or a mix of aluminum and steel. Corner pieces are used to create a closed structure for the work platform 700. The work platform 700 may further comprise planks 702 as shown in FIGS. 30-31, configured to allow a construction worker to walk thereon during the construction process.

Figure 7:
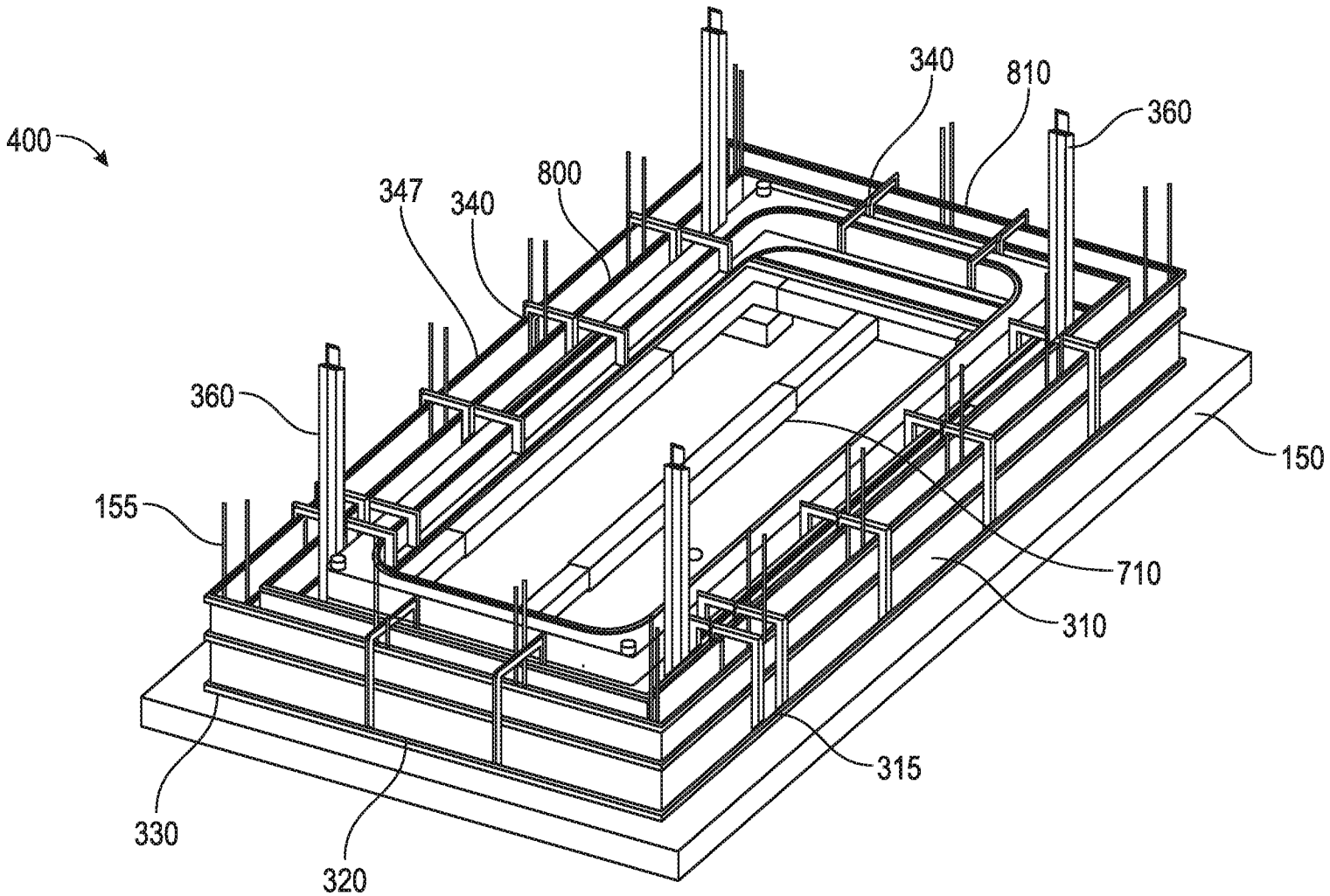
FIG. 7 is a perspective view of an assembled slip form structure, work platform, and main frame supported on vertical geared columns.
Figure 17:
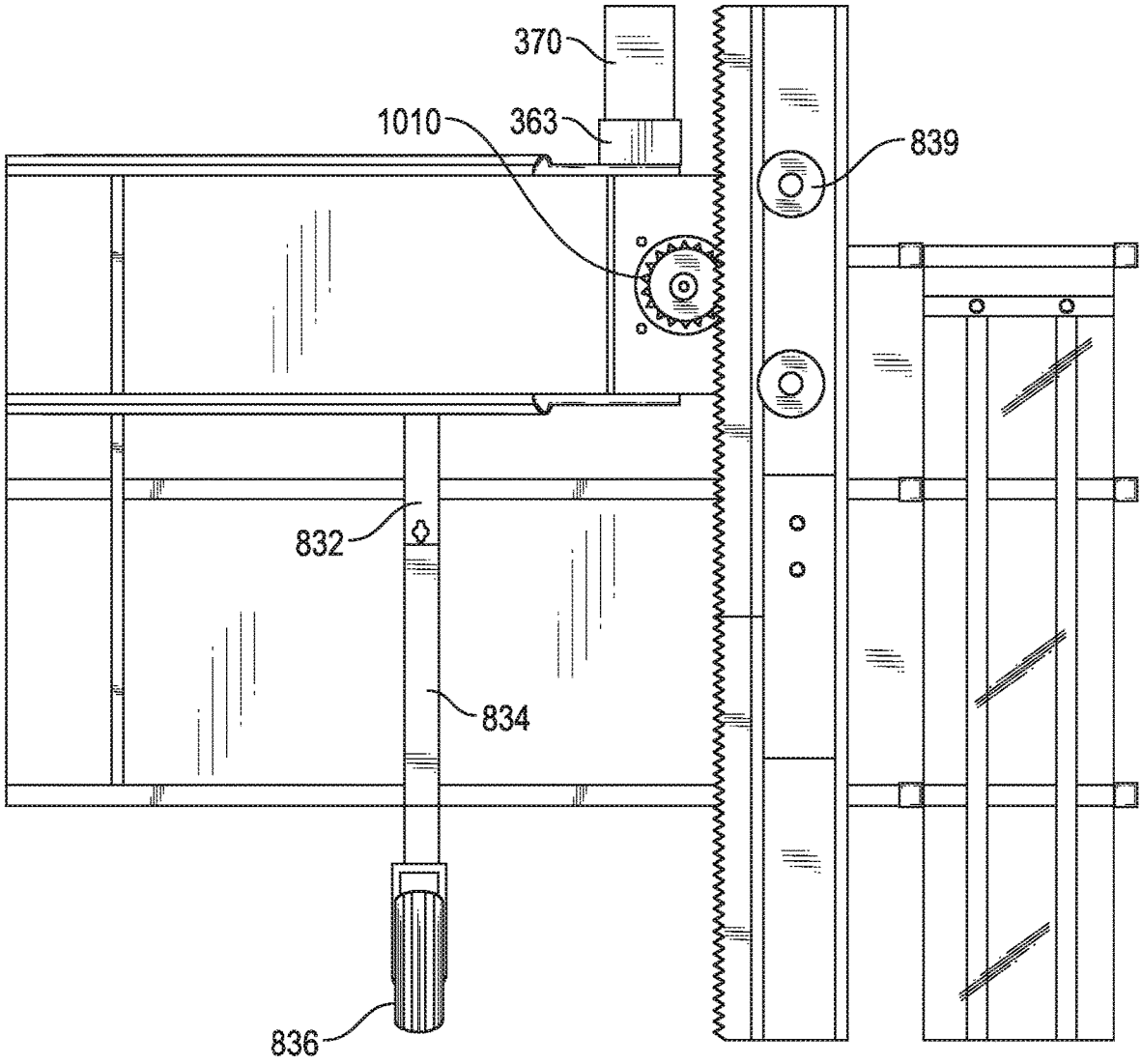
FIG. 17 is a side elevation view of a pinion engaging a geared vertical column.

FIG. 7 is a perspective view wherein a main frame 800 has been coupled to the flanges 340 of the slip form structure 400. In other words, the main frame 800 and the slip form structure 400 are now operationally coupled. Vertical columns 360 have a geared rack (as best seen in FIG. 17) along their lengths. The teeth 362 are configured to interact with respective geared motors that are attached to the main frame 800. An illustrative geared motor is seen at 1000 in FIG. 15.

It is noted that a separate motor 1000 is intended to be placed along each column 360. In other words, a motor 1000 is secured to the main frame 800 at each corner, or near thereto. In addition, a motor 1000 may be secured to each corner of the work platform 700. In this way, the work platform 700 is separately driven up the columns 360, below the main frame 800. However, it will be noted that while geared vertical columns 360 are illustrated, geared columns are not required and other means may be used. For example, cable-driven systems, hydraulic systems, or similar means may be used. In other words, the main frame 800 may be slidably coupled to the vertical columns 360, wherein the main frame 800 and/or work platform 700 slides on the columns using a series of cables, pulleys, and motors, as is known in the art of elevators.

Figure 8:
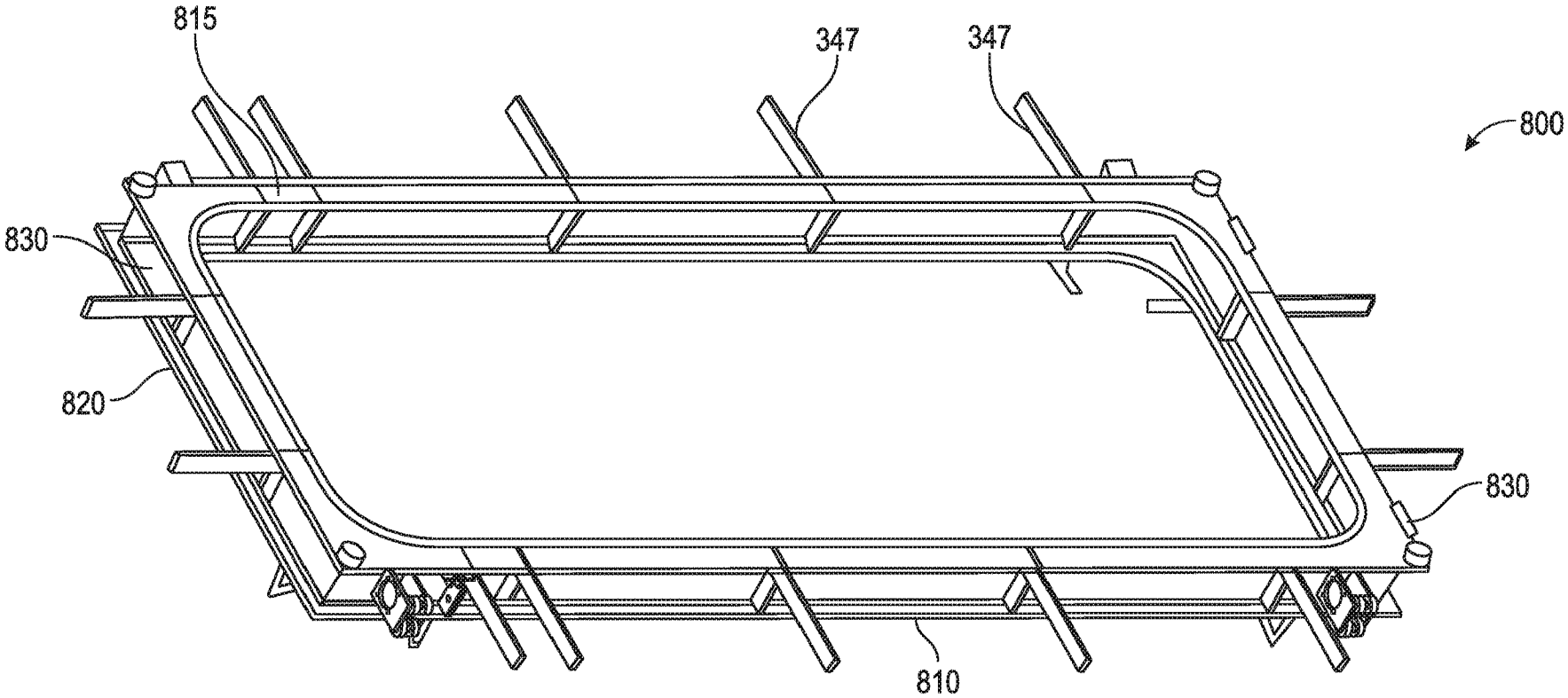
FIG. 8 is a perspective view of a main frame.

FIG. 8 is a perspective view of the main frame 800, in one embodiment. The main frame 800 is comprised of a series of frame sections connected through bolts. The frame sections include side sections 810, end sections 820 and corner sections 830. Optional custom-length sections 815 may also be employed.

In the view of FIG. 8, a plurality of illustrative L-angle brackets 347 are seen. The L-angle brackets 347 extend outwardly from a perimeter of the main frame 800. As noted above in connection with FIG. 7, the L-angle brackets 347 are coupled to the flanges 340 of the slip form structure 400. Preferably, every flange connection, that is, the bolted joinder of flanges 340, receives an L-angle bracket 347.

Figure 9:
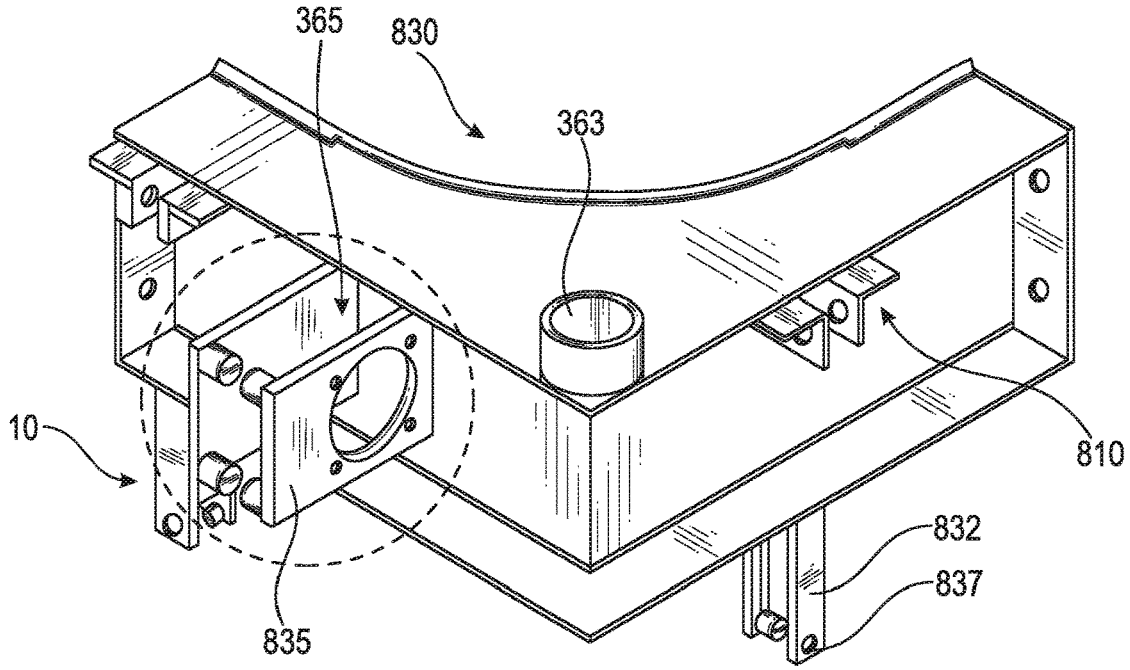
FIG. 9 is detailed view of a corner of the main frame.

FIG. 9 is a first perspective view of one of the corner sections 830 that is part of the main frame 800 of FIG. 8. The corner section 830 includes an aperture 365. The aperture 365 is dimensioned to receive a geared vertical column 360, such as the illustrative column 360.

The corner section 830 also includes a pair of brackets 810. The brackets 810 are designed to be pinned to the proximal end of a lever (shown at 834 in FIG. 29). In this way, a pivoting connection is provided between the proximal end of the lever 834 and the corner section 830.

The corner section additionally includes two pairs of adjacent posts 832. Each post 832 extends down from the corner section 830, and includes a pair of aligned holes 837. The aligned holes are configured to receive a pin (shown at 831 in FIG. 29). The pin 831, in turn, is connected to a respective lever 834. The pin 831 serves as a travel limit for guide wheels (seen at 836 in FIG. 29).

In operation, the brackets 810 provide a fulcrum that allows the guide wheels 836 push against dry concrete. The posts 832 serve as a mounting system for the guide wheels 836.

Figure 10:
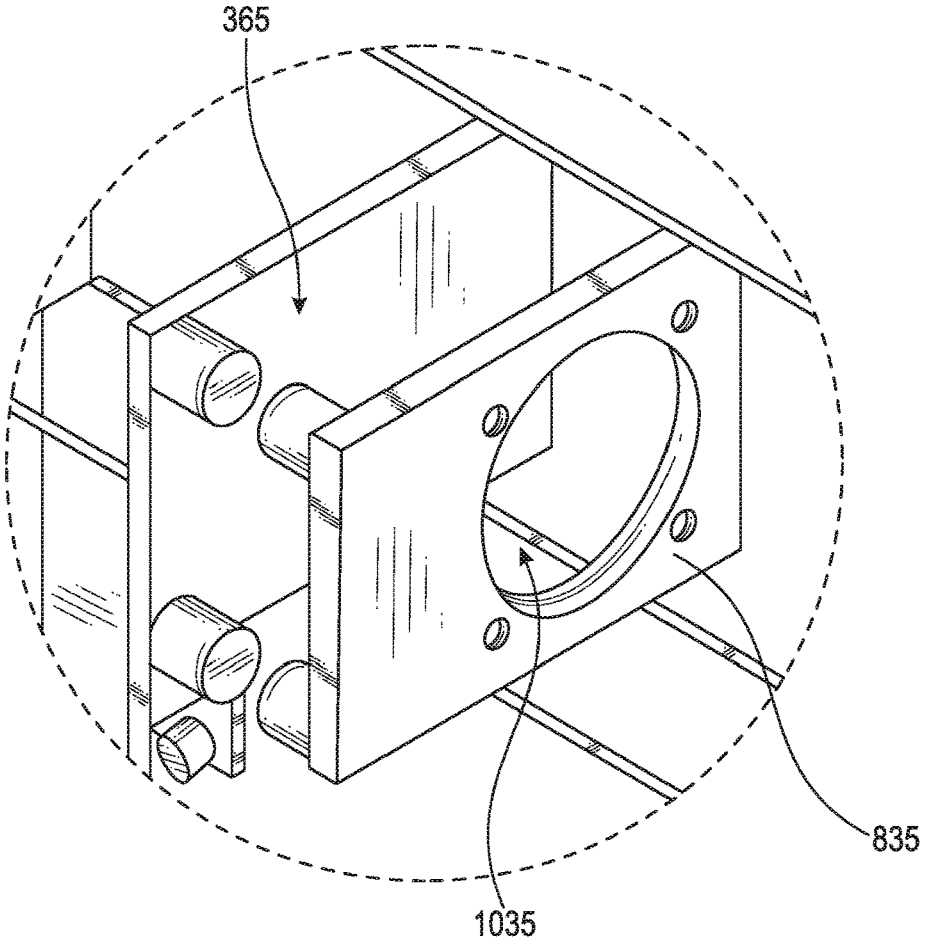
FIG. 10 is a detailed view of an aperture for receiving a geared column formed from brackets.
Figure 16:
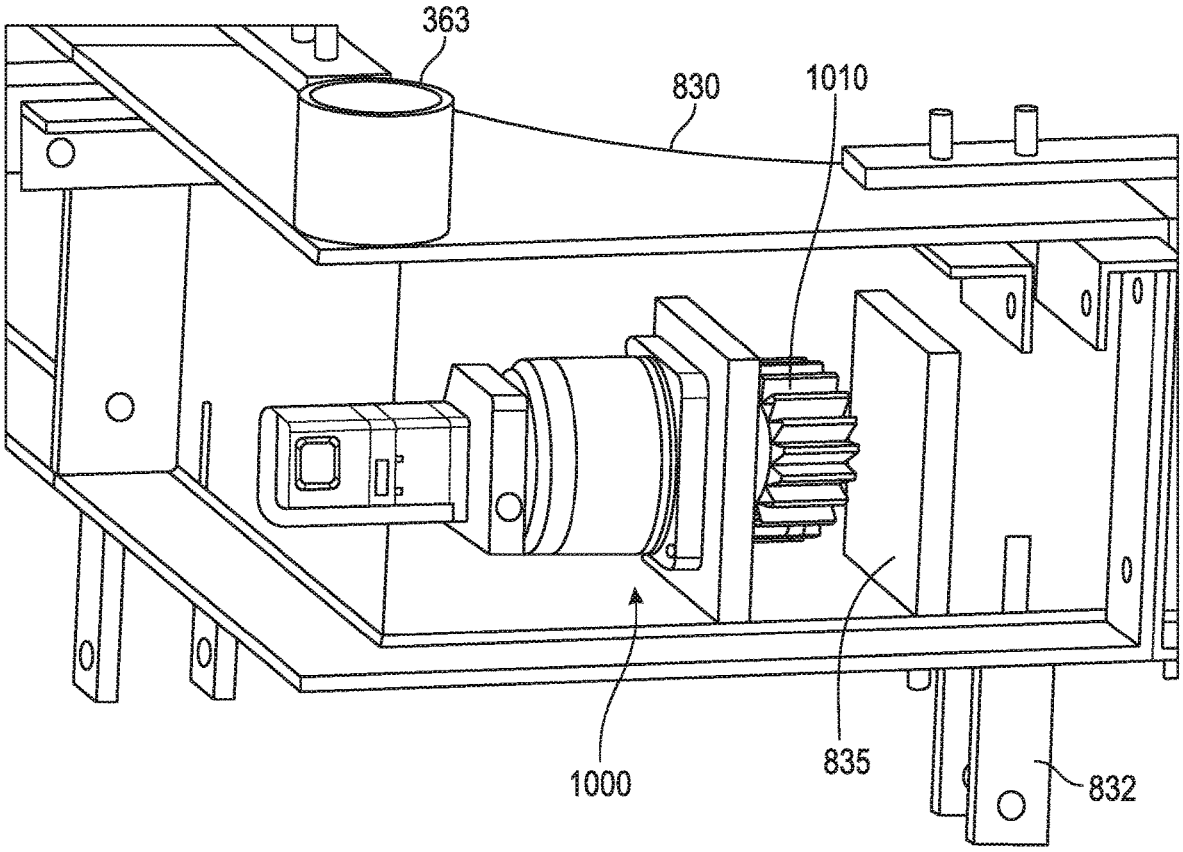
FIG. 16 is a perspective detailed view of a motor configured with the pinion in an aperture for receiving a geared vertical column.

FIG. 10 is an enlarged view of a portion of the corner section 830 of FIG. 9. FIG. 10 shows a pair of adjacent plates 835. The plates 835 have an aperture 1035 for receiving the pinion 1010 of the motor 1000, as shown in FIG. 16. The plates 835 form an aperture 365 therebetween for receiving the geared column 360, the geared side of the column 360 engages the pinion 1010 of motor 1000, as shown in FIG. 17.

Figure 11:
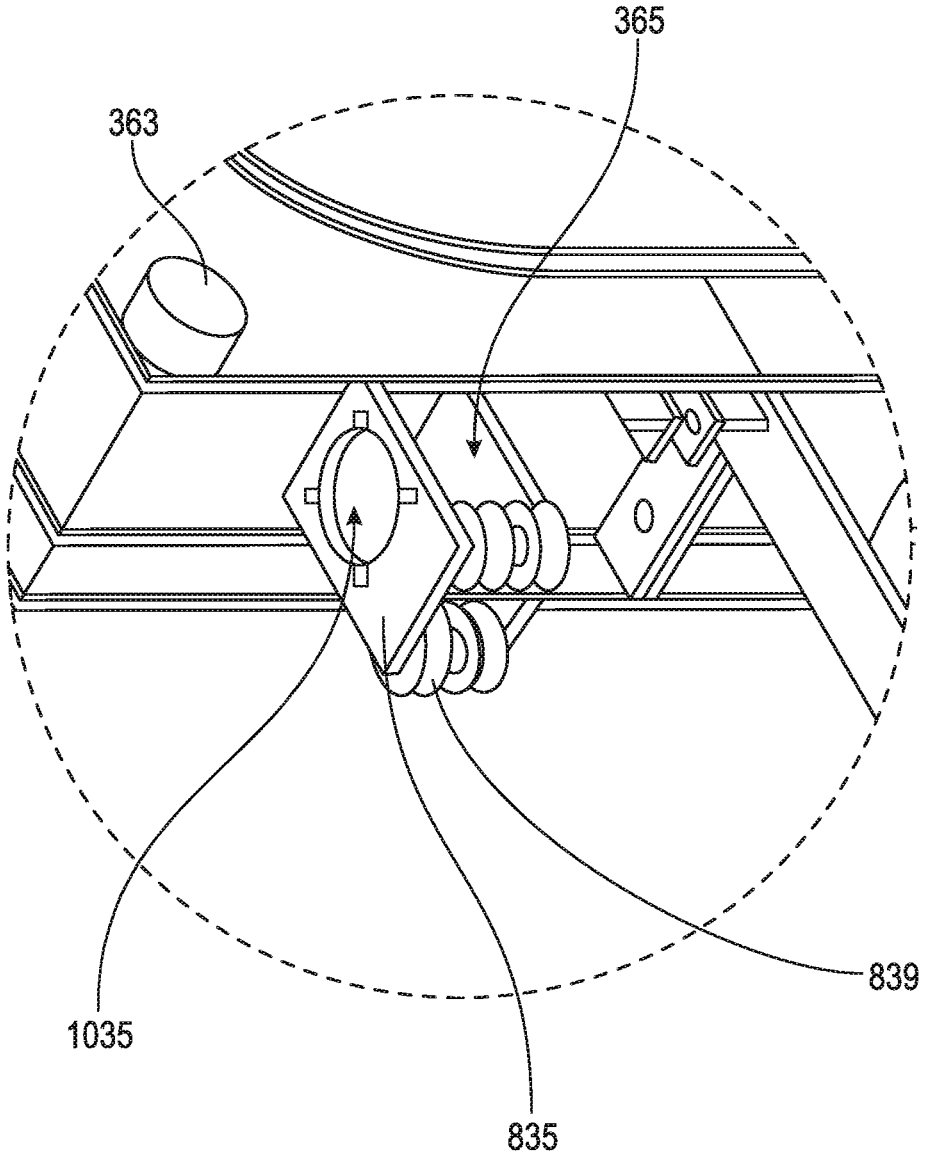
FIG. 11 is a detailed view of an aperture for receiving a geared column having rollers coupled thereto.

In FIG. 11, rollers 839 are visible. The rollers 839 ride against the side of the column 360 opposite the gears. This creates a counter-pressure to the rack and pinion 1010 and helps ensure a stable and smooth travel, as well as ensuring that the rack (geared side) and pinion 1010 stay engaged.

Figure 12:
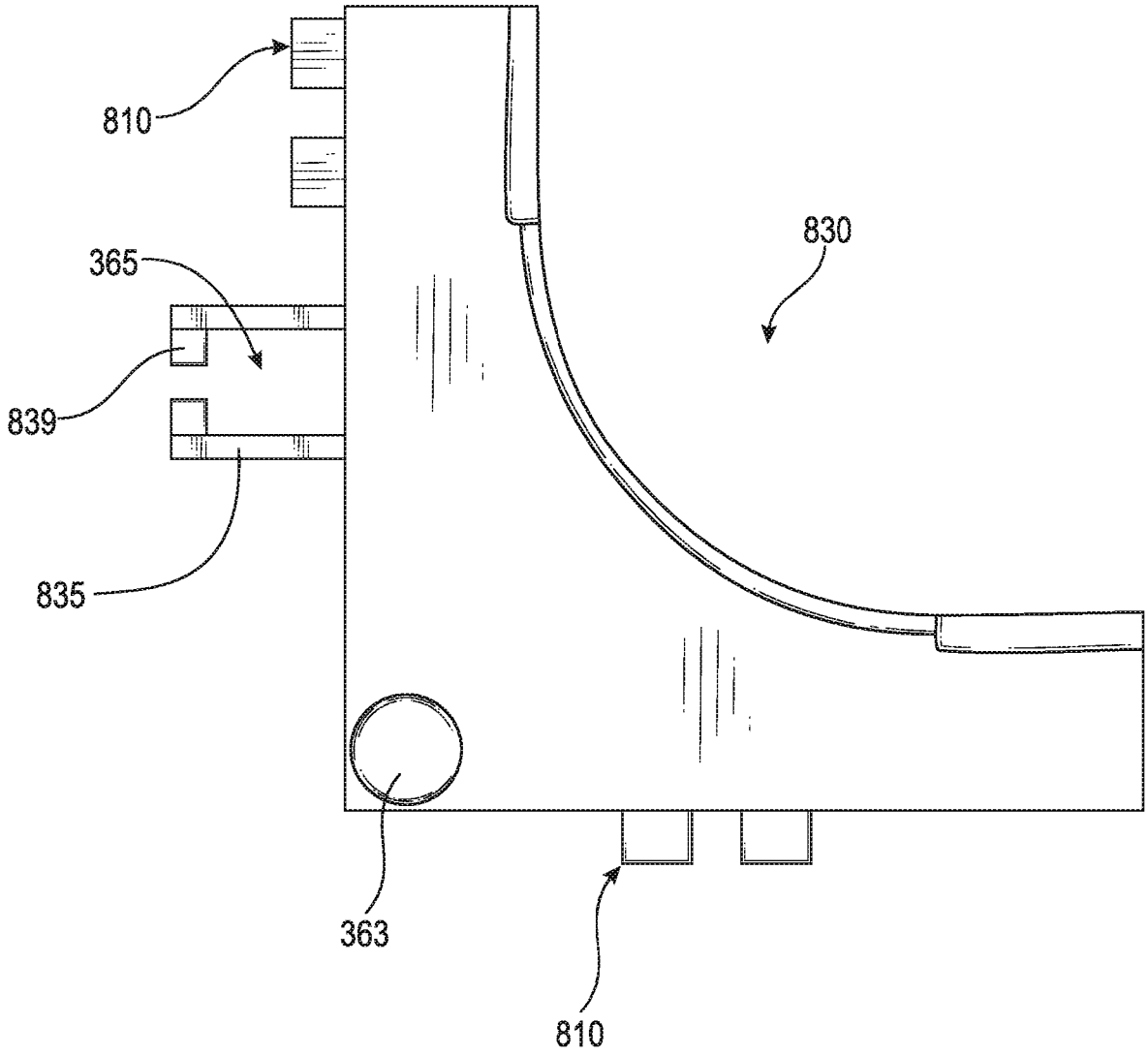
FIG. 12 is a top plan view of a corner of the main frame.
Figure 13:
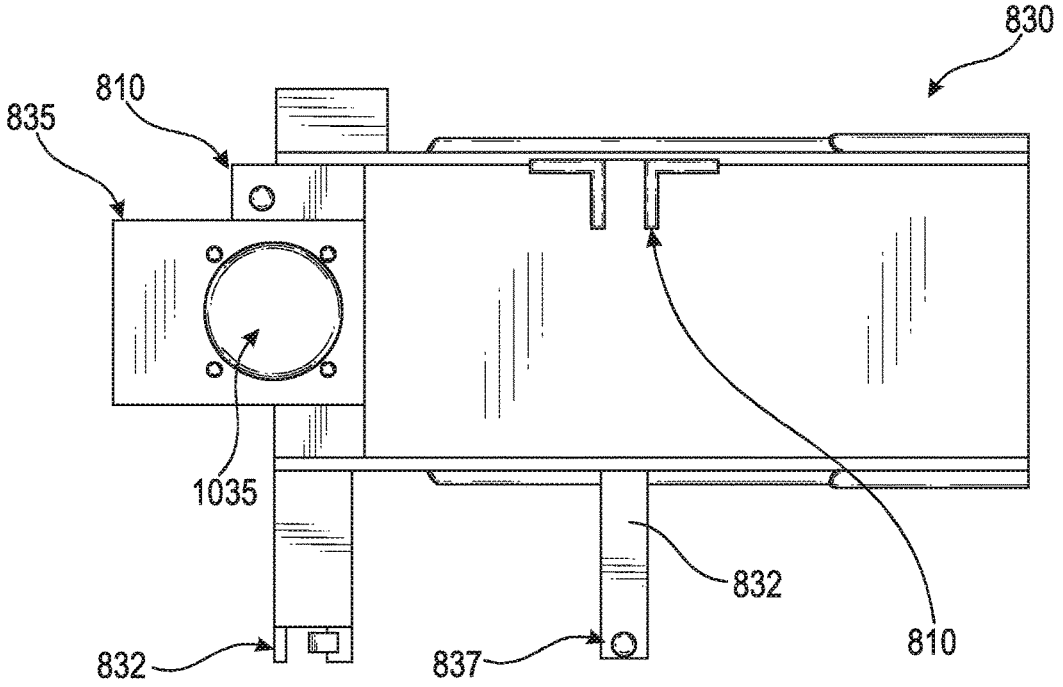
FIG. 13 is a side elevation view of a corner of the main frame.
Figure 14:
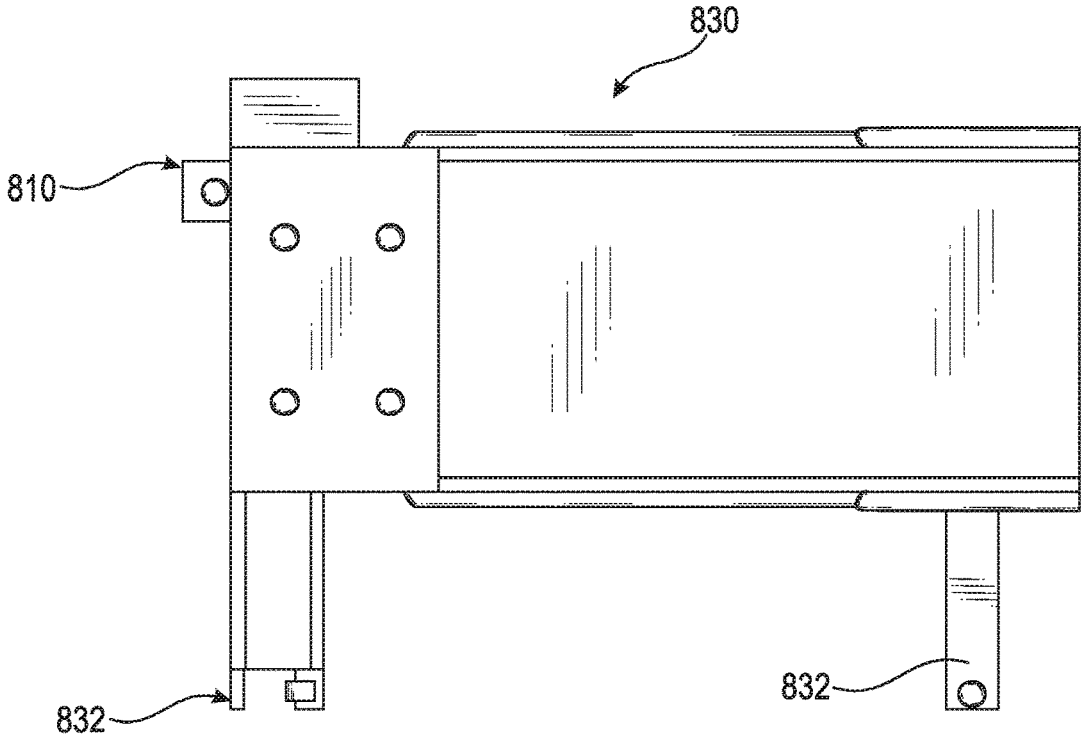
FIG. 14 is an alternate side elevation view of a corner of the main frame.

FIGS. 12-14 illustrate additional views of the corner section 830. Adjacent steering brackets 810 and adjacent posts 832 are again seen. The aperture 1035 is also visible.

Figure 15:
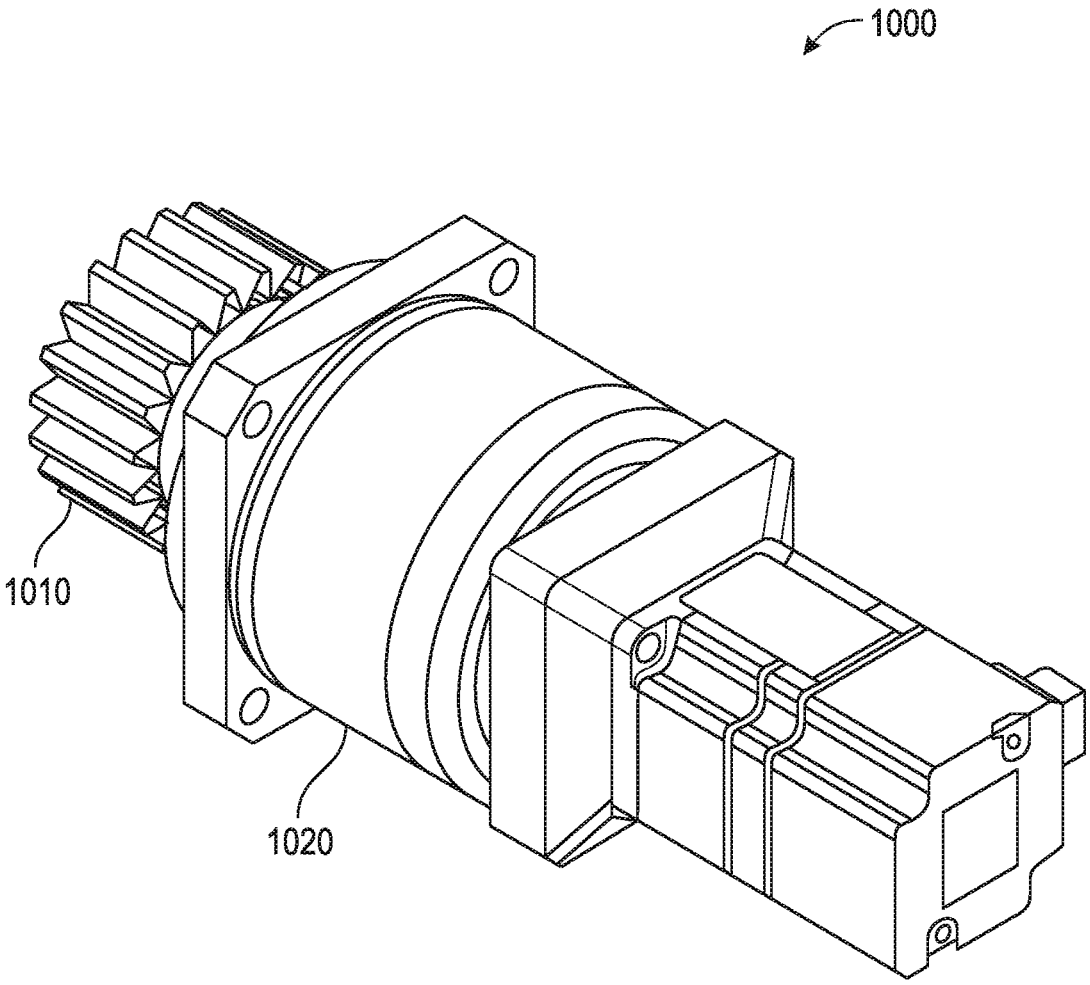
FIG. 15 is a perspective view of a motor with pinion.

FIG. 15 is a perspective view of an illustrative drive motor 1000 as may be used to move either the work platform 700 or the main frame 800.

FIG. 16 is a perspective view of a drive motor 1000 coupled to a corner 830. As shown, the pinion 1010 passes through aperture 1035 and resides in the aperture 365 formed by the two plates 835.

FIG. 17 is a side elevation view demonstrating the rack-and-pinion interaction between the drive motor 1000 and a vertical column 360. In this view, the pinion 1010 is engaged with the rack of the vertical column 360. The side opposite the rack engages the rollers 839, which ensure the vertical column remains engaged with the pinion 1010.

Figure 18:
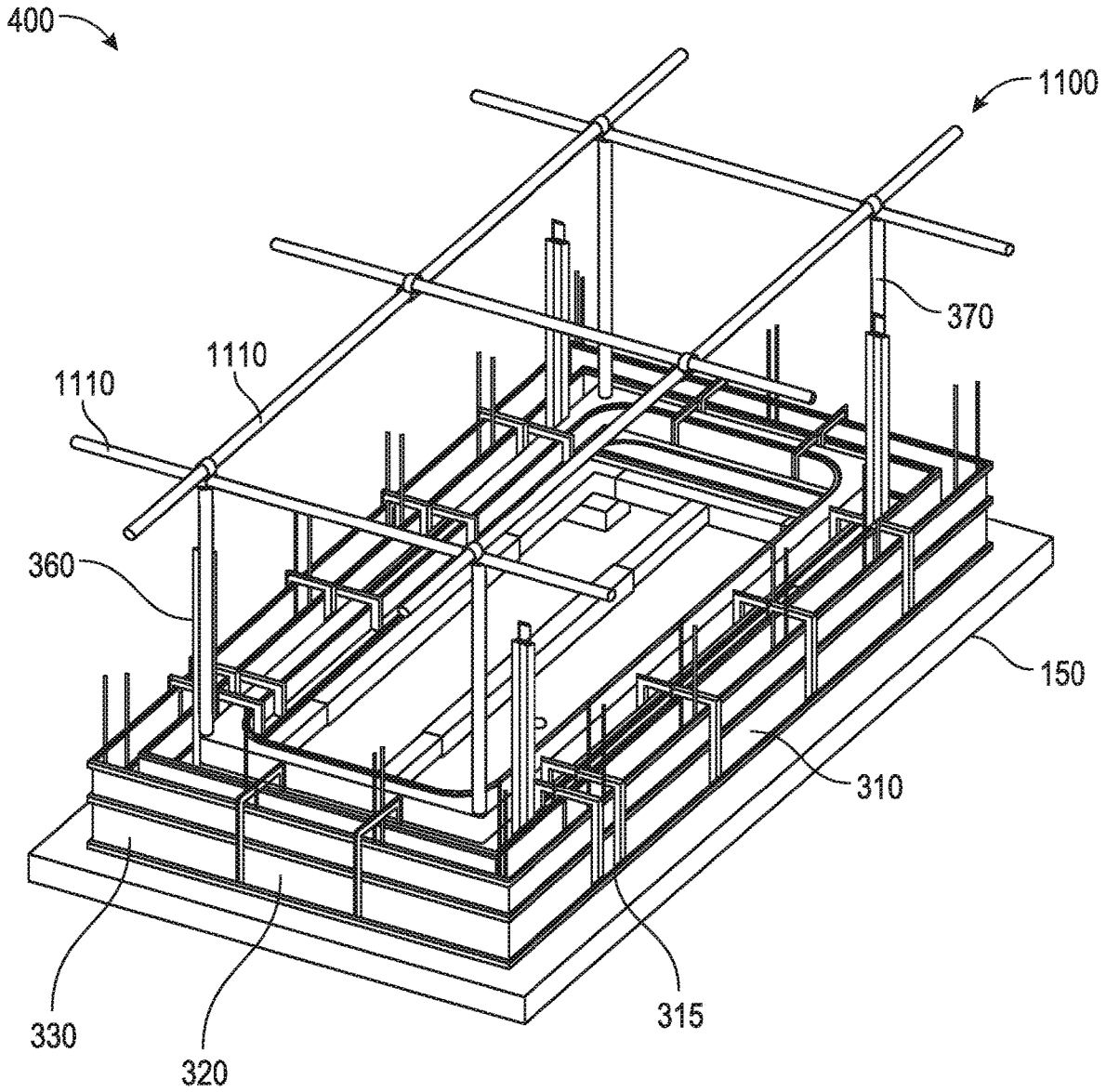
FIG. 18 is a perspective view of a system for forming a vertical structure through the incremental pouring of wet concrete without a conduit.

FIG. 18 illustrates the system for forming a vertical structure through the incremental pouring of wet concrete having a canopy 1100. The canopy 400 is supported by the canopy columns 370, which are inserted into canopy receiver 363. Because the canopy columns 370 are secured to the corners of the main frame 800, as the main frame 800 rises, the canopy 1100 rises with it.

It is observed that the canopy 1100 includes a plurality of cross-members 1110. The cross-members are designed to support a tarp or other weather-insulating material (not shown). Those of ordinary skill in the art will understand that concrete is sensitive to temperature and moisture.

Figure 19:
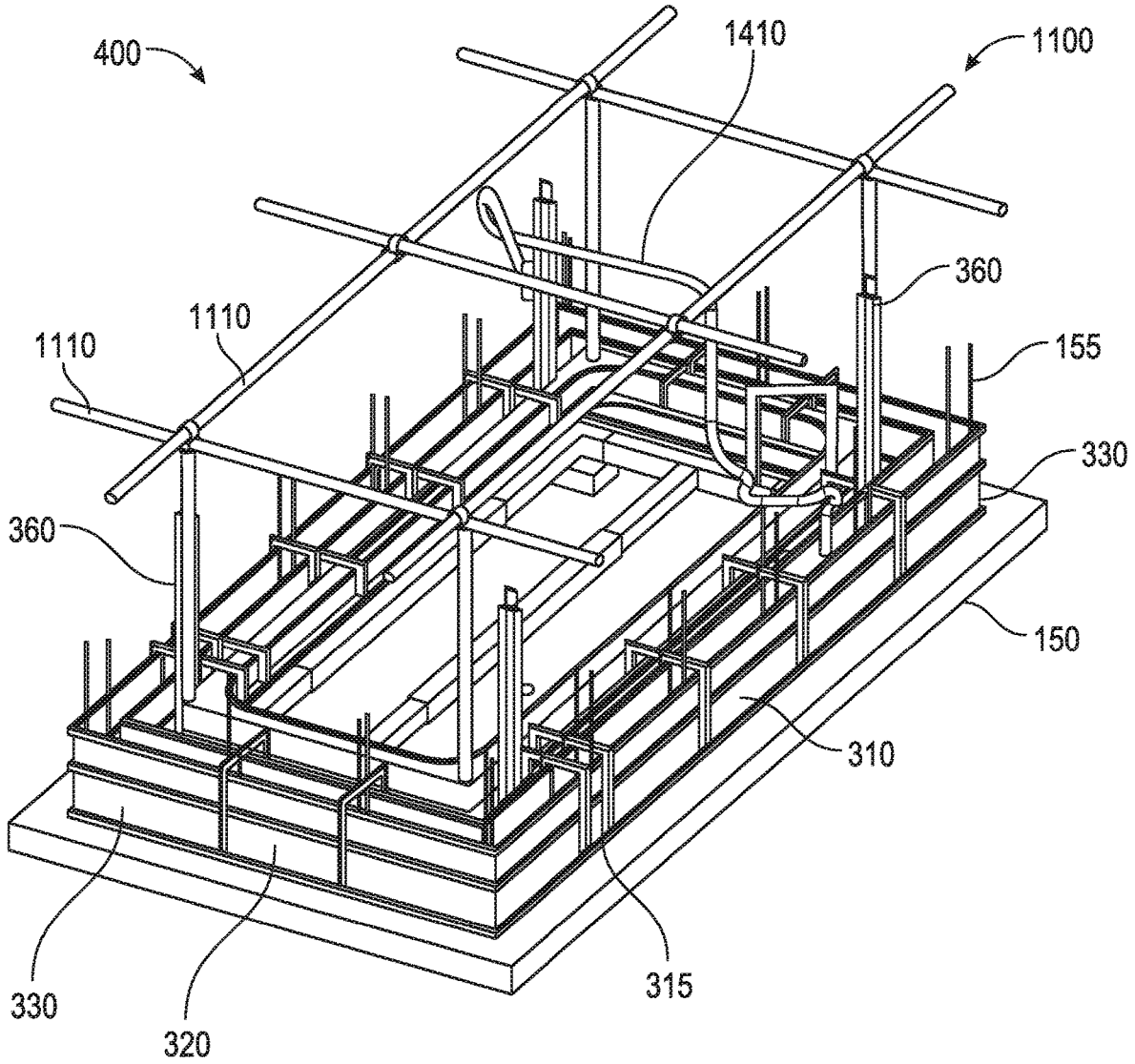
FIG. 19 is a perspective view of a system for forming a vertical structure through the incremental pouring of wet concrete with a conduit.

In one embodiment, as shown in FIG. 19, the system for forming a vertical structure through the incremental pouring of wet concrete further comprises a novel concrete slurry delivery system (or conduit assembly). The concrete slurry delivery system includes a conduit 1410. In one embodiment, the concrete slurry delivery system also includes a series of swivels 1420 placed in series along the conduit 1410. The concrete slurry delivery system 1400 further includes a nozzle 1450 and a distance sensor 1430.

The concrete slurry delivery system 1400 may also include one or more micro-motors 1460. The micro-motors reside near the nozzle 1450 and impart vibratory energy at the nozzle 1450. This assists in moving the low-viscosity concrete slurry out of the nozzle 1450 and into the trough formed by the slip form structure 400.

Figure 20:
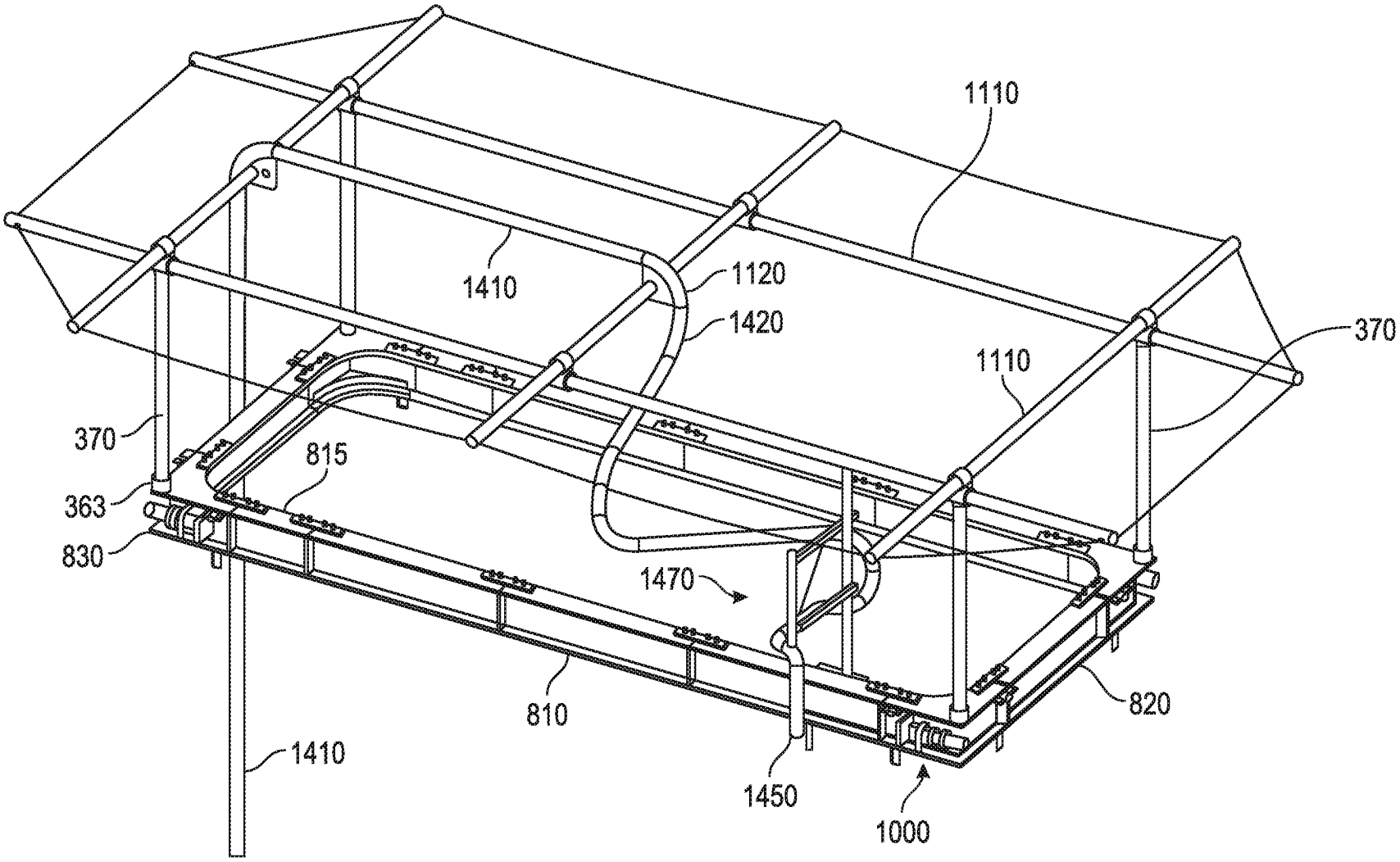
FIG. 20 is a perspective view of a main frame, canopy, and conduit of a system for forming a vertical structure through the incremental pouring of wet concrete.

FIG. 20 is a perspective view of the canopy 1100, in one embodiment, residing over the main frame 800. The canopy columns 370 support the canopy cross-members 1110 and the conduit 1410 and are received into canopy receivers 363.

Also visible in FIG. 20 are components of the concrete slurry delivery system. These include the conduit 1410 and the swivel connections 1420 along the conduit 1410. Also visible are conduit support members 1120 that reside along the canopy cross-members 1110 to support the conduit 1410. In addition, a knuckle boom 1470 is shown supporting the nozzle 1450. The knuckle boom 1470 is presented and described more fully below.

Figure 21:
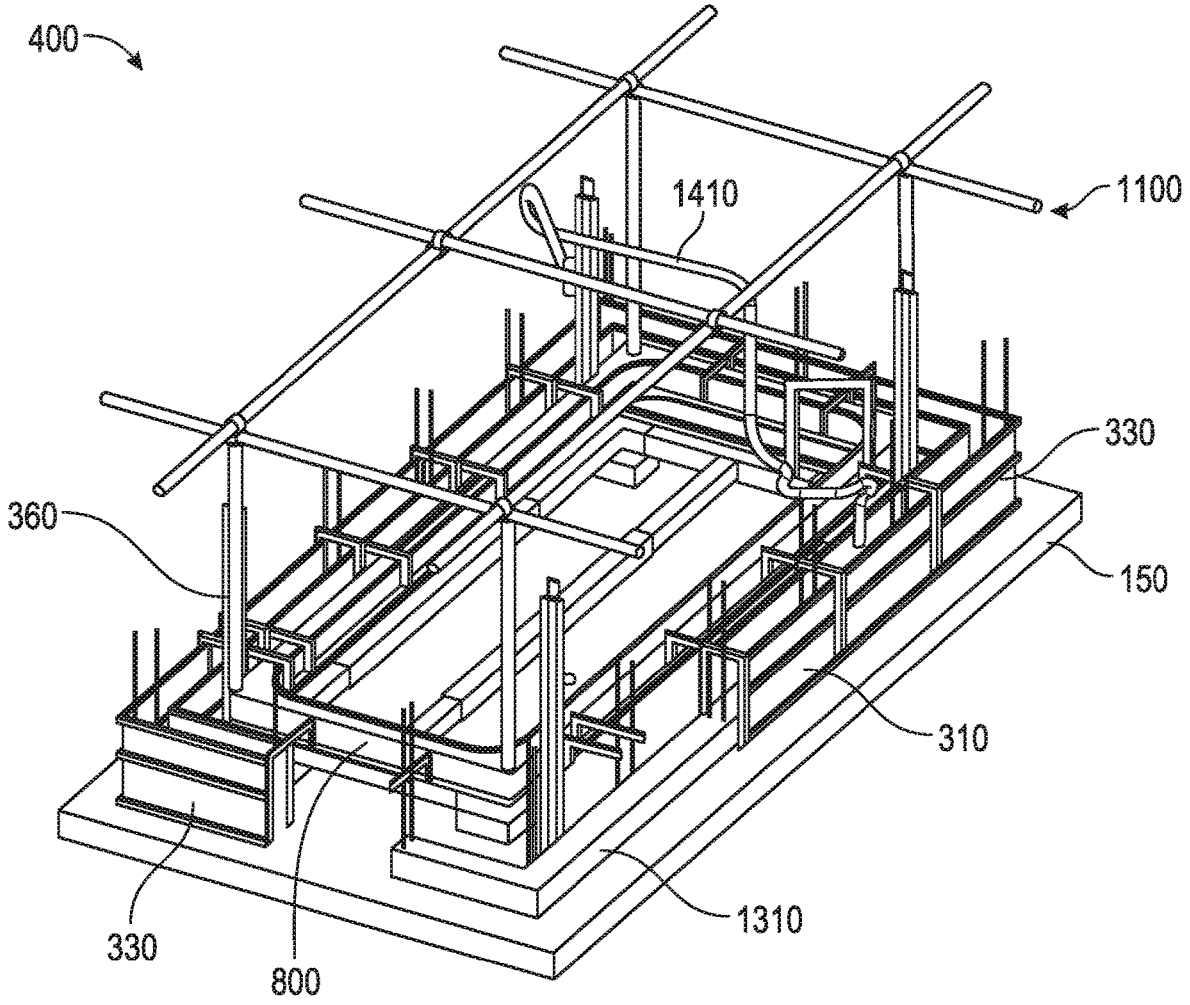
FIG. 21 is a perspective view of a system for forming a vertical structure through the incremental pouring of wet concrete with the first layers of concrete poured.
Figure 22:
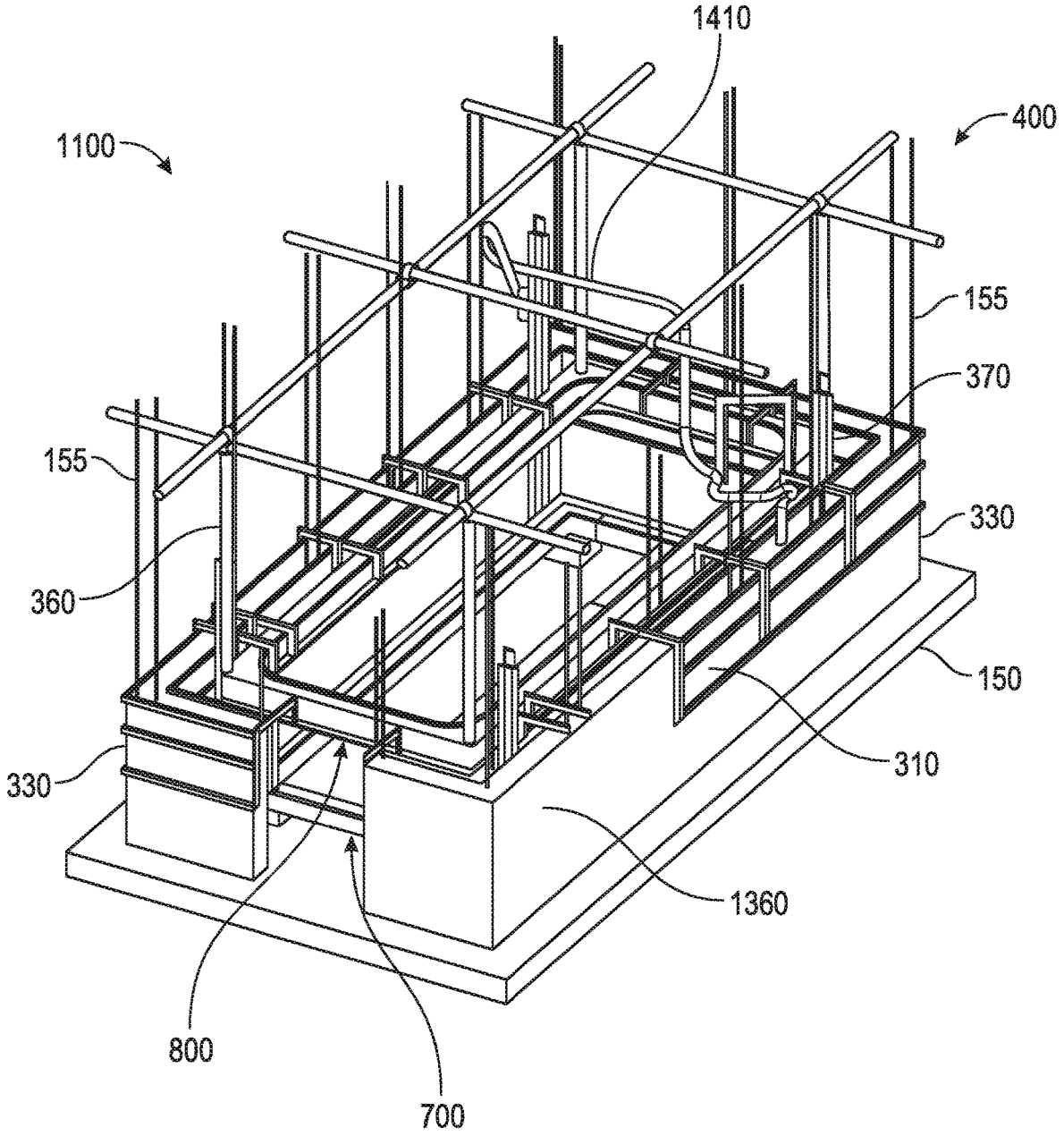
FIG. 22 is a perspective view of a system for forming a vertical structure through the incremental pouring of wet concrete with successive layers of concrete poured, the system being elevated accordingly.
Figure 23:
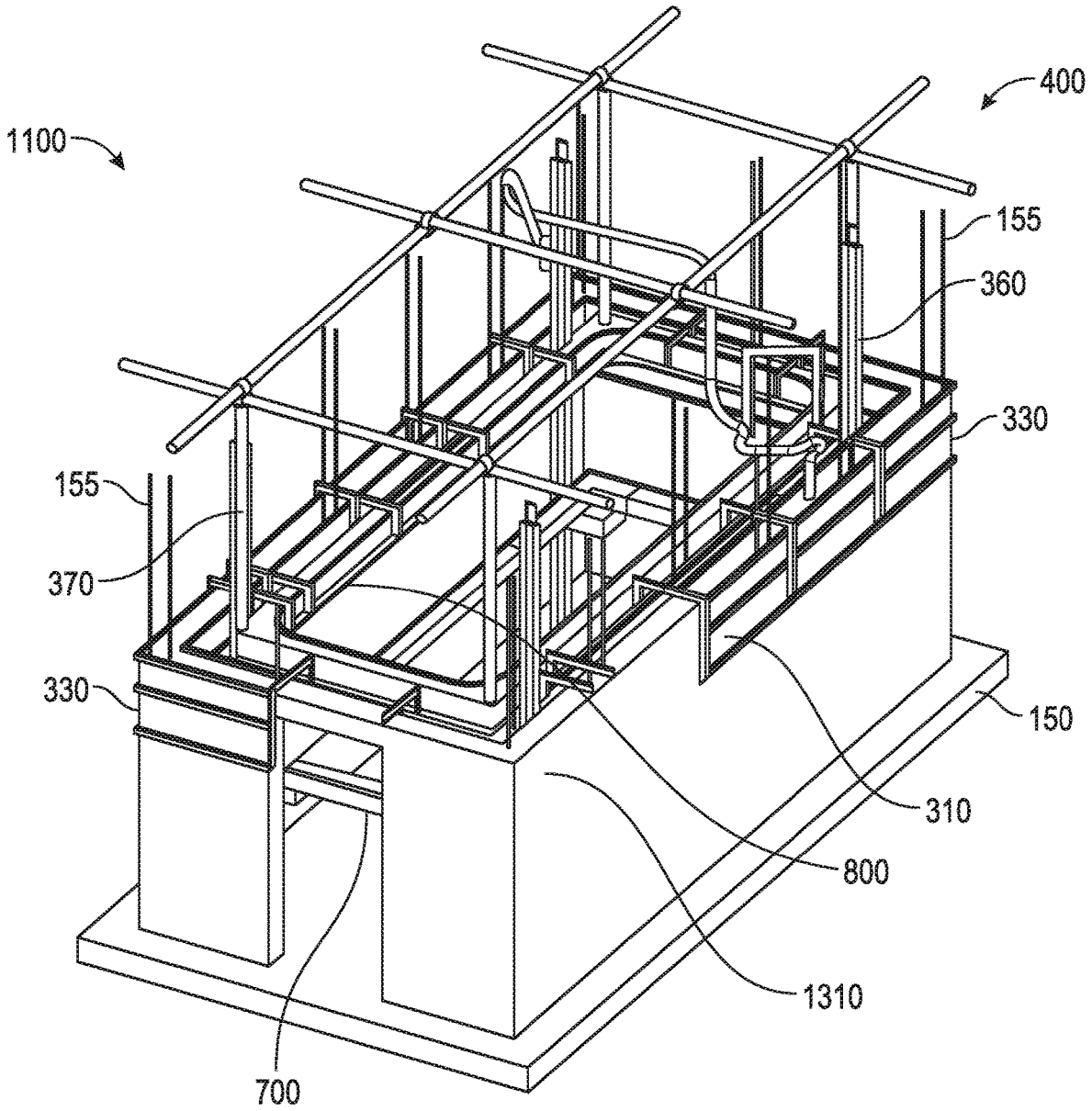
FIG. 23 is a perspective view of a system for forming a vertical structure through the incremental pouring of wet concrete with successive layers of concrete poured, the system being elevated accordingly.

FIGS. 21-23 illustrate the system for forming a vertical structure through the incremental pouring of wet concrete at various stages. In FIG. 21, a first layer of concrete 1310 has been poured through the nozzle 1450 of the concrete slurry delivery system. Selected slip form sections (including custom-length section 315) are removed for illustrative purposes, revealing the first layer of concrete 1310. The first layer 1310 may be, in one non-limiting example, 8 to 12 inches in depth. As illustrated, door forms (known in the industry) have been placed along the slip form structure 400. The door forms preserve a space for a "first floor" door. The door forms may be secured to end flanges 340, or may slide into slots (not visible) at the end of the corner sections 330.

FIG. 22 is a next perspective view. In this view, the pouring of concrete slurry into the slip form structure 400 continues. The conduit 1410 is again seen above the slip form structure 400, delivering wet concrete slurry to the nozzle 1450. In one embodiment, the nozzle 1450 is motorized, allowing it to move about the perimeter formed by the slip form structure 400.

In one embodiment, the concrete slurry delivery system is automated. To this end, the nozzle 1450 includes an associated sensor capable of detecting a distance between the nozzle 1450 and a surface. In this instance, the surface is a layer of wet concrete being poured into the trough formed by the slip form structure 400 as the concrete layer is formed.

Figure 25:
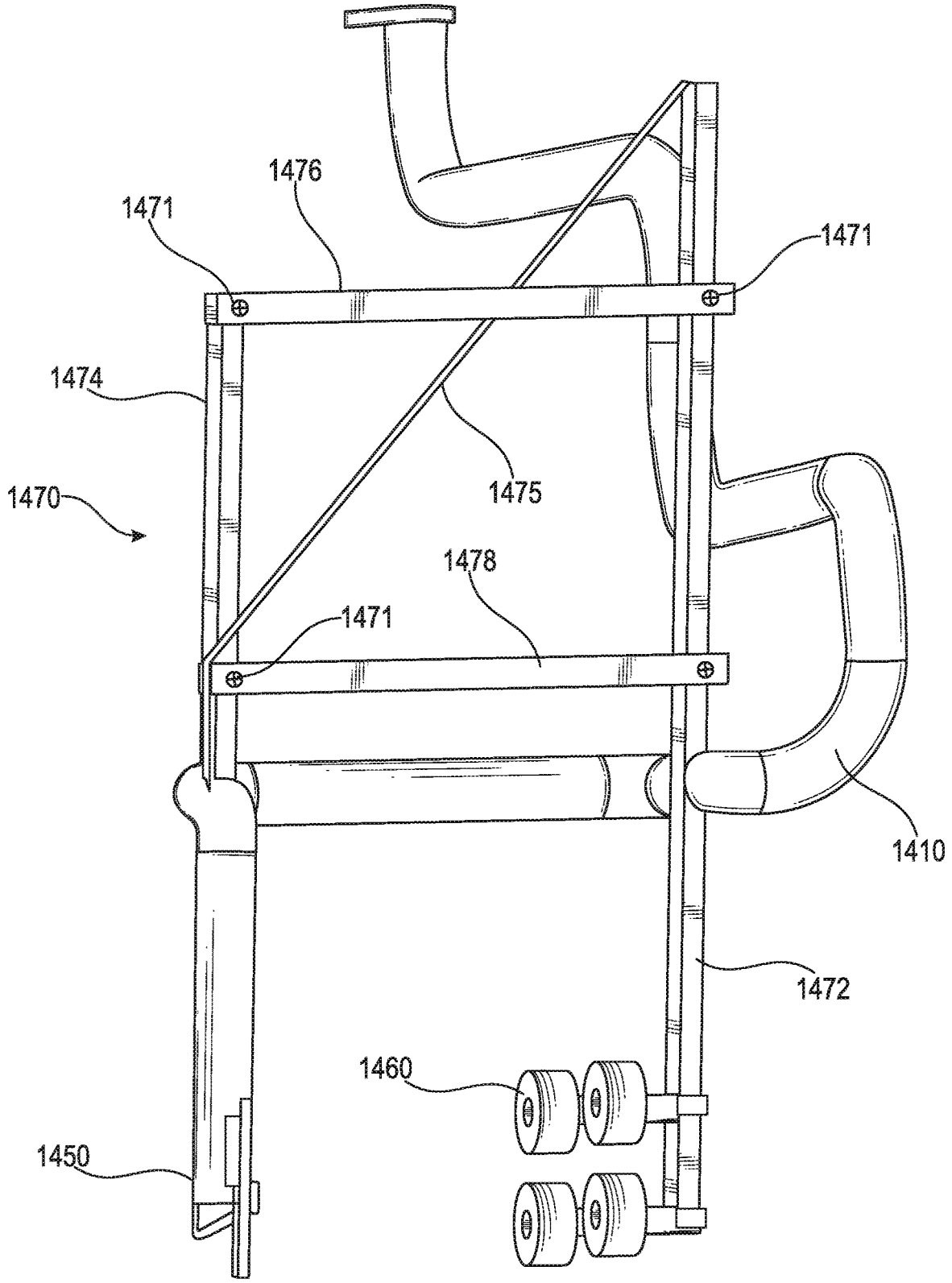
FIG. 25 is a perspective, detailed view of a conduit and nozzle in a first position.

The illustrative concrete slurry delivery system includes a knuckle boom 1470, as best seen in FIG. 25. The boom 1470 allows the nozzle 1450 to be moved in both x and y axes around the slip form structure 400. Separate sensors (not shown) may be placed along the knuckle boom 1470 helping to guide the knuckle boom 1470 as it travels around the perimeter of the slip form structure 400.

In operation, as wet concrete is poured into the slip form structure 400, distance readings are taken by the nozzle 1450 sensor. These are optionally recorded by an on-board processor and analyzed (such as by using a microcontroller). Once a designated distance (or distance bandwidth) is recognized, the nozzle 1450 is closed (such as by means of an automated valve) and redirected to a new pouring location along the slip form structure 400. This process is repeated until a first layer of wet concrete is laid.

In an alternate, and more preferable, arrangement, the nozzle 1450 continually moves during the pouring process. Signals from the nozzle 1450 sensor are analyzed by a processor to determine a rate of change in the distance readings. If the rate of change increases, then the nozzle 1450 is moved more quickly; if the rate of change decreases, then the nozzle 1450 is moved along the trough more slowly.

In either instance, a second layer of wet concrete is not poured until the first layer of concrete 1310 is completed. In one aspect, a drying time of, for example, one hour may be applied before the pouring of the second layer commences. The first layer of concrete 1310 will have begun to set, but need not be completely dry. Ambient conditions and structural dimensions will dictate how quickly the second layer of wet concrete 1310 is poured after the first layer has been laid. Depending on a rate of setting, the operator may need to wait 30 minutes to 90 minutes after the first layer is poured before beginning to pour the second layer of concrete 1310. The rate of concrete slurry injection through the nozzle 1450 may also affect wait time.

As the main frame 800 is being raised, this, in turn, raises the slip form structure 400 a selected amount over the most recent layer of wet concrete 1310. In one embodiment, this is a mechanical process that is conducted without hydraulic rams (or jack rods) or hydraulic jacks. In such a scenario, the rack-and-pinion configuration described earlier is utilized. However, it will be appreciated that the present invention is not limited to rack-and-pinion configuration, and more traditional hydraulic systems may be utilized.

In one aspect, as soon as wet concrete has approached the top of the trough formed by the slip form structure 400 across the entire perimeter, the slip form sections 310, 315, 320, 330 are automatically raised. This may be done in response to a processor having directed the knuckle boom 1470 entirely across the perimeter of the slip form structure 400. Alternatively, this may be done in response to laser beam sensors residing at the top of the slip form sections 310, 315, 320, 330 sensing complete cover. Alternatively still, this may be done in response to the operator standing on the work platform 700 and activating the motors 1000 manually. In any instance, it is preferred that the work platform 700 and the main frame 800 are raised together. Because the slip form structure is coupled to the main frame 800, the slip form structure likewise raises. This enables the trough formed by the slip form structure 400 to receive a next layer of wet concrete.

As noted above, raising the main frame 800 is done by activating electric motors 1000 residing at each of the vertical geared columns 360. The motors 1000 are activated and deactivated simultaneously, and are operated at the same rate to ensure that the main frame 800 remains level.

It is also observed in FIG. 23 that additional lengths of rebar 155 and vertical geared columns 360 have been added. This process is done manually, and is periodically repeated until the desired height of the concrete walls is reached.

As part of the process of supporting the main frame 800, concrete embeds 802 may be utilized to secure the vertical columns 360 to the dried concrete walls.

As shown in the FIG. 23 the work platform 700 has also been raised relative to the concrete foundation 150. Raising the work platform 700 may involve the use of motors such as motor 1000, interacting also with the vertical geared columns 360. Alternatively, the work platform 700 may simply be tethered to the main frame 800 by cables, rods, or similar. For example, the cables would be approximately four to six feet in length, and would pull the work platform 700 up as the main frame 800 is lifted while maintaining the work platform 700 in a horizontal orientation.

Figure 24:
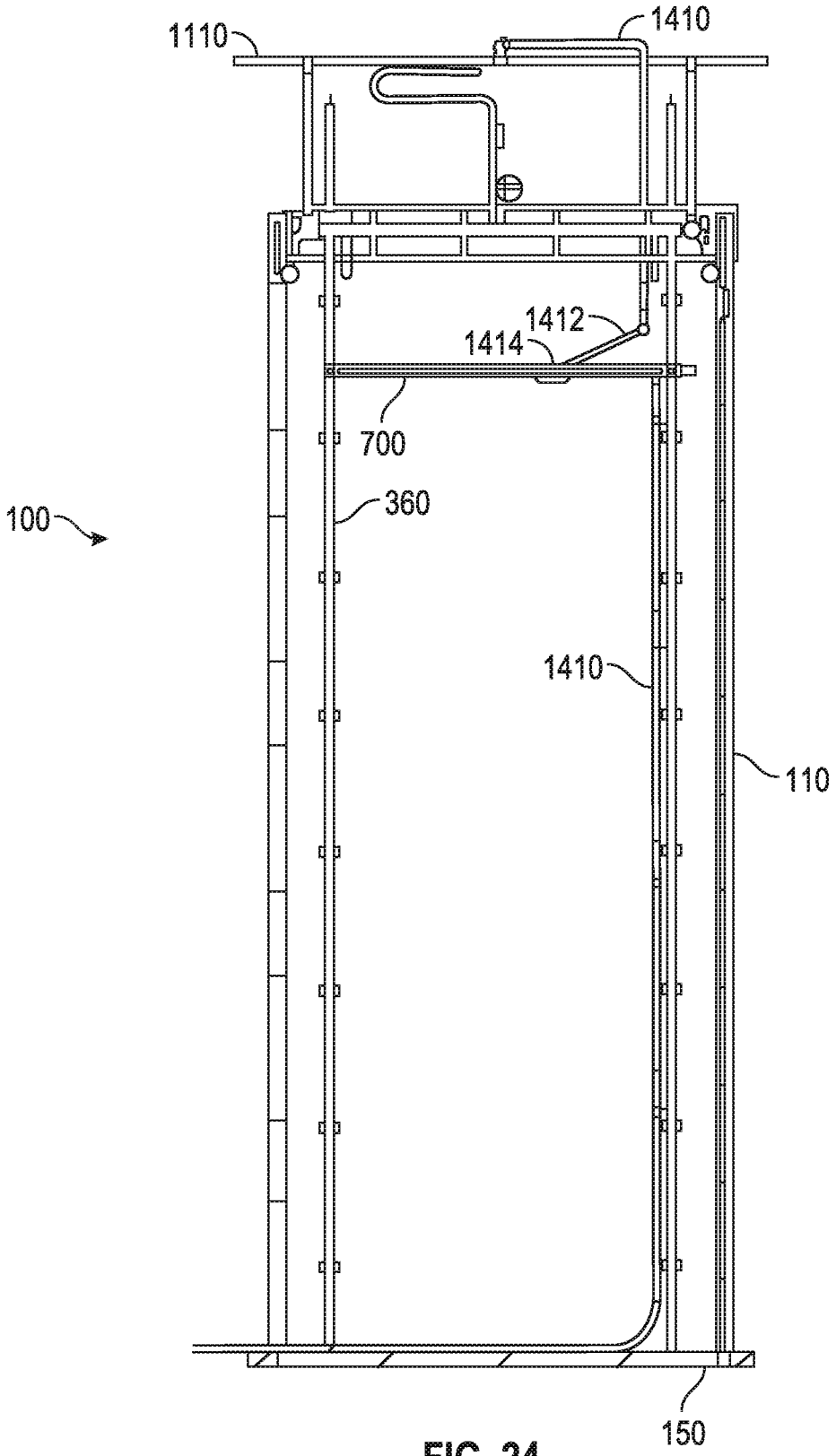
FIG. 24 is a side elevation view of a system for forming a vertical structure through the incremental pouring of wet concrete.

Referring to FIG. 24, a lower portion of the conduit 1410 is seen adjacent the foundation 150. This section is in fluid communication with pumps (not shown), which pump concrete slurry from trucks or tanks placed on-site. The conduit 1410 extends up to the top of the concrete tower. A portion of the conduit 1410 is actually supported by canopy members 1110.

As noted above, the conduit 1410 may include a series of swivels, or swivel connections 1420. The swivels 1420 allow the nozzle 1450 of the concrete slurry delivery system 1400 to be incrementally advanced during the process of pouring each concrete layer. At all times, the concrete slurry delivery system 1400, or more particularly, the nozzle 1450 and associated sensor 1430 and micro-motor 1460, are supported by the canopy 1100, which in turn is supported by the main frame 800.

FIG. 24 is a cross-sectional view of the stairwell tower (or, optionally, the elevator tower) 100 of FIG. 14A, under construction. The concrete slurry conduit 1410 is seen extending from the foundation 150 at ground floor level to the top of the tower 100. Beneficially, excess pipe sections 1412 may be maintained at the work platform 700 to feed additional conduit 1410 as the main frame 800 is periodically raised. A swivel connection 1414 is provided between the excess pipe sections 1412 to enable a folded state of storage.

FIG. 25 is an enlarged view of the nozzle 1450 and connected conduit 1410. The nozzle 1450 and connected conduit 1410 are secured to a frame that may be referred to as a knuckle boom 1470. The illustrative knuckle boom 1470 includes a first vertical frame 1472, a second vertical frame 1474, a first horizontal frame 1476, a second horizontal frame 1478 and a plurality of pivoting connections 1471 pinning the horizontal and vertical frame members together.

The knuckle boom 1470 also includes a draw cable 1475. The draw cable 1475 is mechanically pulled by a winch or kinematic mechanism powered by a motor when a sensor senses an obstacle along the slip form structure 400. For example, the draw cable 1475 may be pulled by activating a winch (not shown). In the view of FIG. 25, the draw cable 1475 is extended and the nozzle 1450 is in its extended, pouring position.

The winch may be powered and controlled by an on/off state controlled by a concrete pouring control system. Alternatively, the kinematic mechanism may be powered and controlled by a servomotor control system. The servomotor control is triggered by sensors located on the nozzle 1450. The sensors located on the nozzle 1450 may detect concrete depth and obstacles encountered during the pour. The sensors may be any combination of pressure, ultrasonic, optical, capacitive, or Hall Effect. The knuckle boom 1470 is moved by a motor including optionally a servomotor, hydraulic motor, or a speed controlled motor.

An optional sensing and control system may be utilized including a set of three to four video cameras for sensing the nozzle 1450 location by image processing in a video control system. The optional video controller communicates control signals to a winch, a servomotor controller in a kinematic mechanism for extending and retracting the nozzle 1450 and to a motor or servomotor for moving the knuckle boom 1470. Combinations of local nozzle and video sensors may be used in conjunction with the concrete pouring control system. Inputs may also include safety inputs to insure the safety of workers and operators.

The concrete pouring control system may contain and make use of a PID (proportional, integral, derivative) control algorithm and other controls programming to calculate and communicate on/off pour control command to the nozzle 1450 valve and micro-motor, on state communicated at the beginning of the pour and off state communicated when a pour is completed. The control system may employ a PLC (programmable logic controller) for programming and executing the controls programming including optionally PID programming. The control system may also include and HMI (human-machine interface) for entering parameters and controlling and monitoring the pour process.

Figure 26:
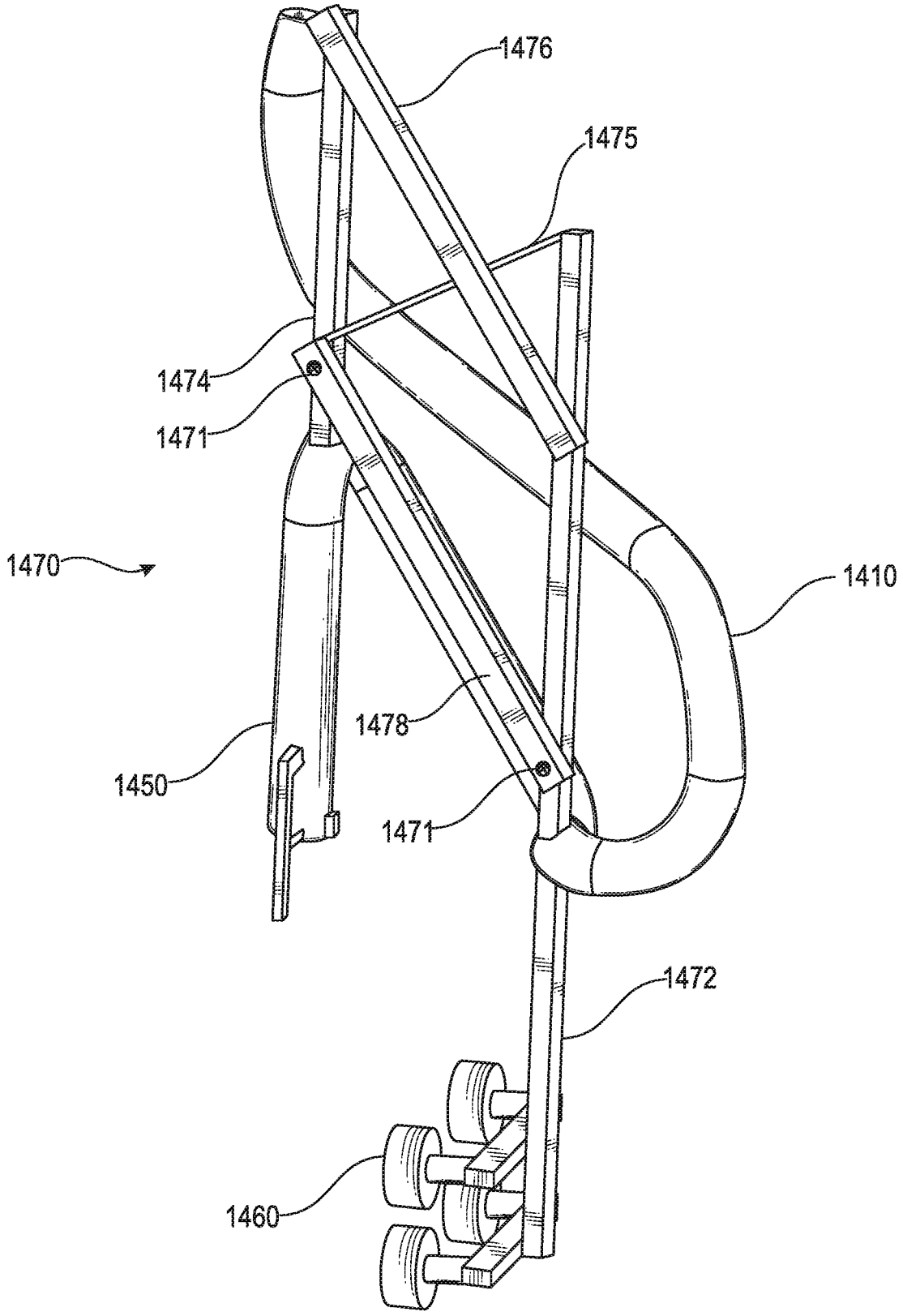
FIG. 26 is a perspective, detailed view of a conduit and nozzle in a second position.

Also visible in FIGS. 25-26 is a set of wheels 1460. The wheels 1460 are configured to engage a track located along an interior side of the slip form sections 810, 815, 820, 830. The wheels 1460 allow the knuckle boom 1470 to be pulled around the slip form structure 400. The concrete pouring control system communicates control signals to a motor or servomotor for moving the knuckle boom 1470.

FIG. 26 illustrates the knuckle boom 1470 is in its retracted position. This allows the nozzle 1450 to avoid rebar and other obstacles around the slip form structure 400.

Figure 27:
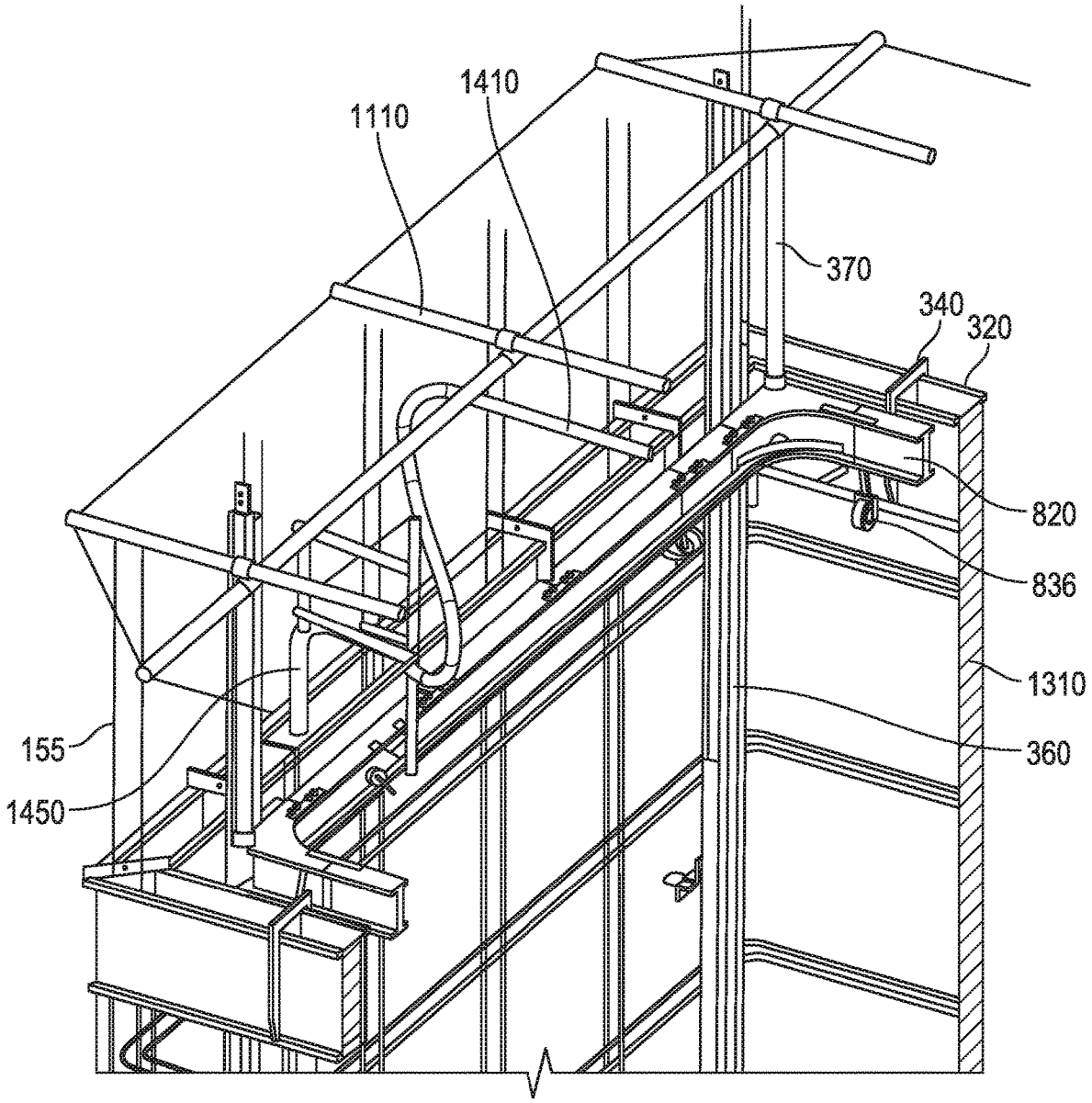
FIG. 27 is a cross-sectional, perspective view of a system for forming a vertical structure through the incremental pouring of wet concrete.

FIG. 27 is a cut-away perspective view of an upper portion of a tubular concrete tower 100 under construction. A portion of the main frame 800, canopy 1100 and conduit 1410 are visible.

Figure 28:
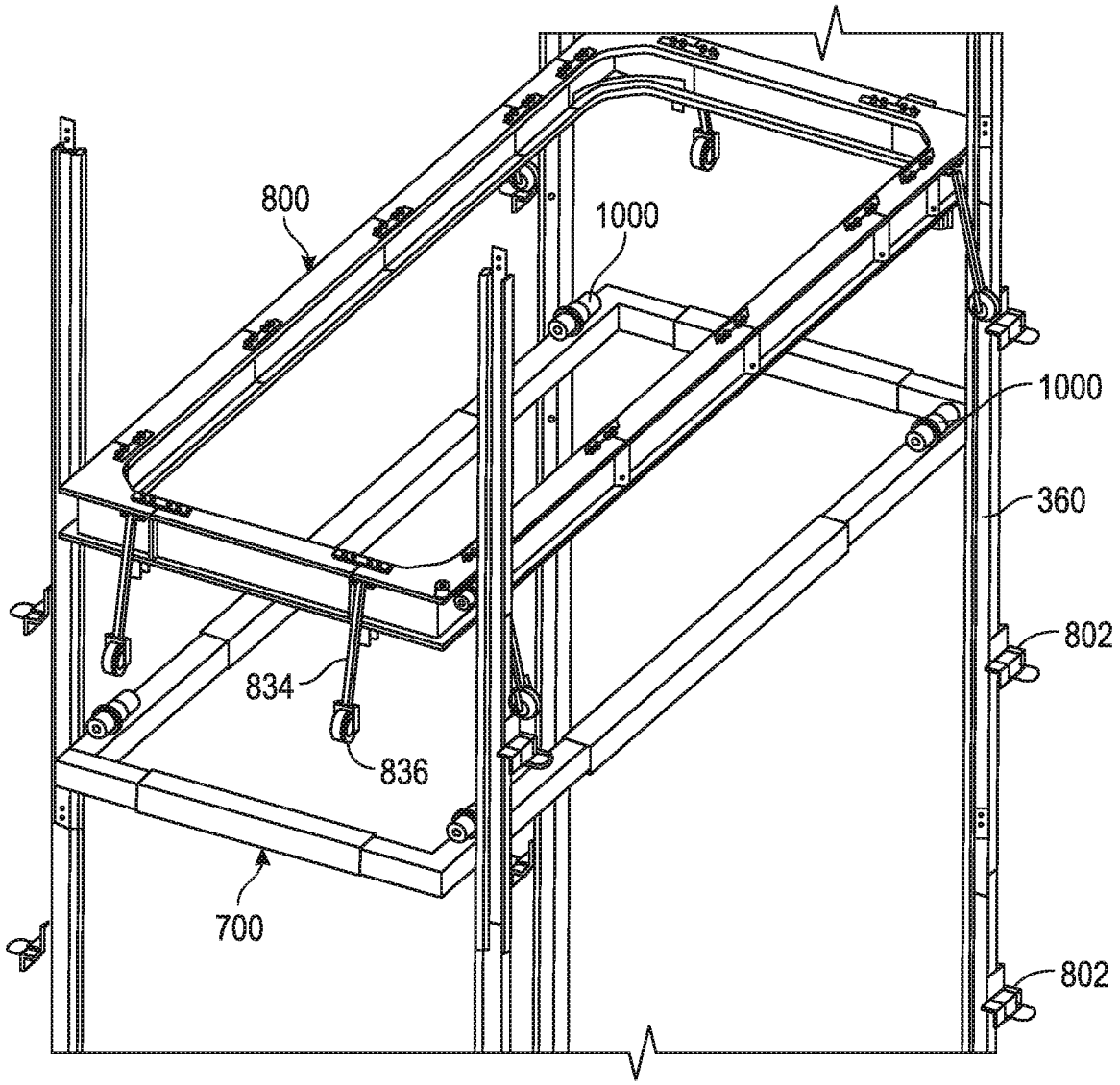
FIG. 28 is a perspective view of a system for forming a vertical structure through the incremental pouring of wet concrete.

FIG. 28 is a perspective view of the main frame 400, and the work platform 700 positioned below the main frame 800. The main frame 800 and the work platform 700 are shown riding along the teeth of the four geared vertical columns 360.

Figure 29:
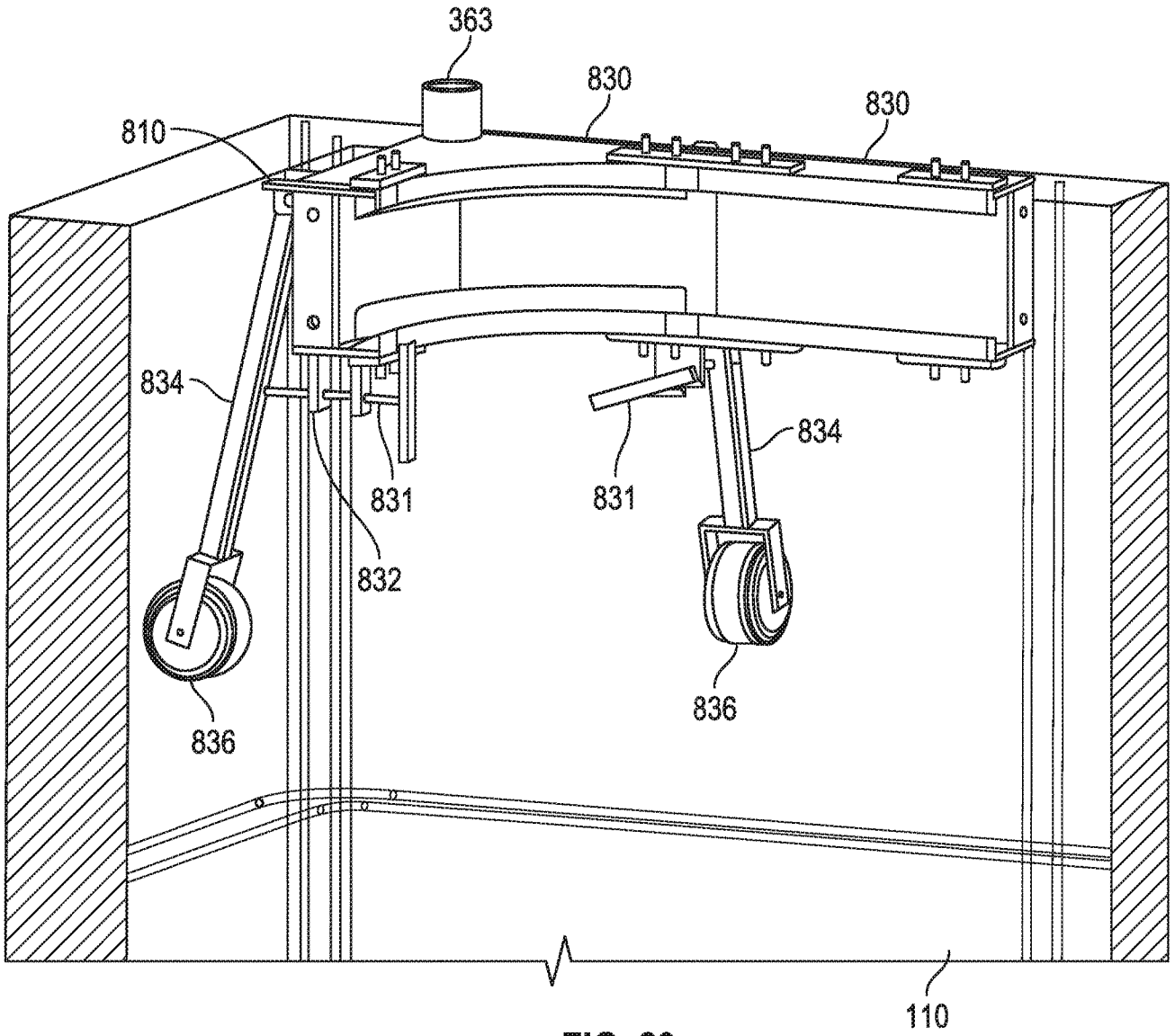
FIG. 29 is a cutaway view of the main frame in relation to poured concrete.

FIG. 29 is an enlarged perspective view of a corner section 830 of the main frame 400. Guide wheels 836 are seen extending from the illustrative corner section 830. The guide wheels 836 are secured at the end of levers 834. Each lever 834 has a proximal end and a distal end. The proximal end is secured to the corner section 830 using brackets 810 to create a pivoting connection. The distal end extends below the main frame 800 and is rotationally coupled to the guide wheels 836. Pivoting travel of the levers 834 is limited by a pin 831. The pin 831 moves through holes 837 provided along a pair of posts 832.

FIG. 30 is a top perspective view of the system for forming a vertical structure through the incremental pouring of wet concrete. As shown, the work platform 700 comprises planks 702 to provide a stable surface for workers. The work platform 700 may also support additional equipment, such as electronics and other items that may be needed (e.g., computers or other processing units for controlling the motors 1000 as well as the knuckle boom 1470, nozzle 1450, or other. FIG. 31 is a cross-section of the system for forming a vertical structure through the incremental pouring of wet concrete.

Figure 32:
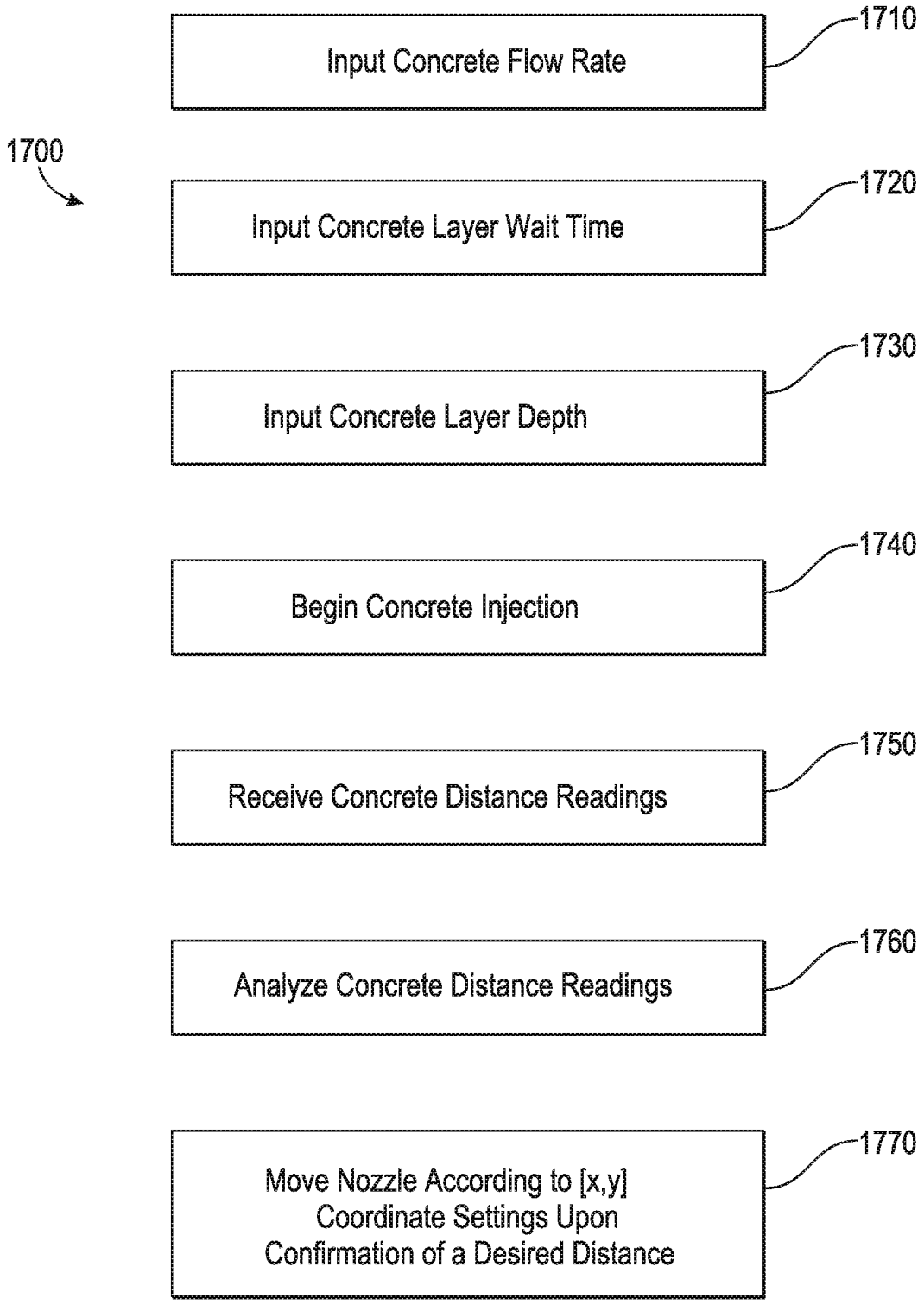
FIG. 32 is a flow chart showing operational steps for a system for forming a vertical structure through the incremental pouring of wet concrete, in one embodiment.

FIG. 32 is a flow chart of one embodiment showing operational steps 1700 for the system for forming a vertical structure through the incremental pouring of wet concrete.

The method 1700 first includes determining a flow rate for the concrete. This rate is optionally input into a processor for automation of concrete delivery, or is set by an operator manually turning a valve or adjusting a nozzle. This step is shown at Box 1710.

The method 1700 next includes determining a concrete layer wait time. This is the amount of time between pouring steps for wet concrete. This wait time again is preferably input into a processor for automation. This step is shown at Box 1720.

The method 1700 additionally includes inputting a concrete layer depth. This is indicated at Box 1730. This step may comprise setting a distance to be sensed by a sensor residing on the concrete nozzle. Thus, during a concrete pour, the sensor will determine that a predetermined concrete layer depth has been reached when the sensor senses that the nozzle has reached a certain distance from the concrete. Alternatively, the nozzle may be in the wet concrete during the pour, and the sensor will sense that the concrete layer has reached the sensor. A signal is then sent to close a valve associated with the nozzle to turn off the flow of wet concrete.

Once the above settings have been determined, the process of injecting concrete begins. This is provided at Box 1740. The automated concrete placement system will lower the nozzle and an associated vibratory device into or over the trough of the slip form structure. Concrete will flow out of the nozzle in order to pour a first concrete layer.

During pouring, sensor readings are made. More specifically, concrete distance readings are taken. This is shown at Box 1750.

Sensor readings will continue to be taken and, optionally, analyzed as shown in Box 1760. When the sensor determines that the level of concrete has risen to the desired depth, the nozzle will begin to travel along the perimeter of the slip form structure while continuing to dispense concrete.

In accordance with the method 1700, the nozzle will move according to [x, y] coordinate settings. This is provided at Box 1770. The speed of movement of the nozzle will be determined by the sensor measuring the pour depth. As the concrete level rises, the sensor will accelerate the nozzle's movement to prevent overfilling of the form.

It is noted that as the nozzle moves along the trough, it will encounter obstacles. Such obstacle may include rebar and embedded vertical support columns. When the nozzle reaches an obstacle, a sub-sequence will run commanding the concrete pump to shut off. The nozzle will then lift out of the concrete (with the vibrator still running), and a valve at the end of the nozzle will close.

The nozzle will sense (or continue to sense) the obstruction while in its elevated position. The nozzle will move until it senses that the obstruction has passed the obstacle. The nozzle will then lower back into the form. The valve will re-open and the nozzle will resume the flow of concrete.

When the nozzle has filed the form to the predetermined pour height throughout the perimeter of the trough, the pump will shut off and the valve for the concrete nozzle will close. The system will then remain stationary for a predetermined period of time while the most-recently poured layer of concrete sets. When the predetermined wait between lifts has been completed, the entire mechanism will climb slowly on the geared vertical columns. This means that motors residing along the outer sides of the main frame are activated, causing rotational movement. Preferably, the vertical columns are stabilized by supports (embeds 802) embedded in the inner wall of the concrete structure during the climb.

When the main frame has climbed a distance equal to the predetermined pour height, it will lock in place, and the wet concrete delivery system will once again be activated. The wet concrete delivery system will then pour another predetermined amount of concrete in the trough of the slip form structure on top of the previous pour. In an alternative embodiment, the system moves slowly and continuously, without the need for the system to remain stationary during any period, barring user intervention.

The working platform operates on the same columns, but separate from the main frame, to service or supply the wet concrete delivery system, and to allow workers to come and go from the work site, such as at day's end. In this way, the main platform and slip form structure can remain at the top of the vertical structure while the user lowers the working platform.

As can be seen, a method for forming a concrete structure using slip forms is provided herein. A concrete or slurry pour depth control system is provided that receives signals and communicates outputs for guidance and depth control. Inputs are local a concrete supply nozzle and optionally include triangulated video signals. The concrete pouring control system may optionally be trained to follow a series of motions along a pathway for use after training to perform that same series of motions including obstacle avoidance motions and pour motions with actual pouring. The concrete pouring control system contains and performs an optimal pour algorithm. The algorithm optimizes concrete pours taking into account parameters such as relative humidity, air temperature, wetness of the concrete, and maximum pour depth to maximize the rate of pour associated with the nozzle speed of movement.

FIGS. 30A-30C present a single flow chart. The flow chart demonstrates steps for a method 1800 for controlling movement of the nozzle 1450 and the slip form structure 400 in connection with the construction of a concrete tower. The method 1800 may also be referred to as a method of operating the system for forming a vertical structure through the incremental pouring of wet concrete.

The method 1800 begins with construction of the system itself. This is shown at Box 1805 of FIG. 18A. The system for forming a vertical structure through the incremental pouring of wet concrete (which may also be referred to as a "concrete printer") will include at least the main frame 800 and the concrete slurry delivery system 1400. The concrete printer will also include the controller, which controls movement of the nozzle 1450 of the system 1400 around.

The method 1800 next includes placing a "Start" switch along the slip form structure 400. This is provided at Box 1810. The Start switch tells the controller where the nozzle 1450 is and when to start a pour layer routine.

The method 1800 additionally includes entering data for the controller. The data pertains to the concrete mixture. This is indicated at Box 1815.

The method 1800 next provides for entering parameters for construction of the concrete tower. This is seen at Box 1820. The design parameters will include ambient temperature, ambient humidity, temperature of the concrete, maximum safe lift speed for the slip form structure 400, maximum safe lateral speed of the nozzle 1450. Other parameters such as nozzle size, pour depth and height of the concrete tower to be constructed may also be included.

Figure 33A:
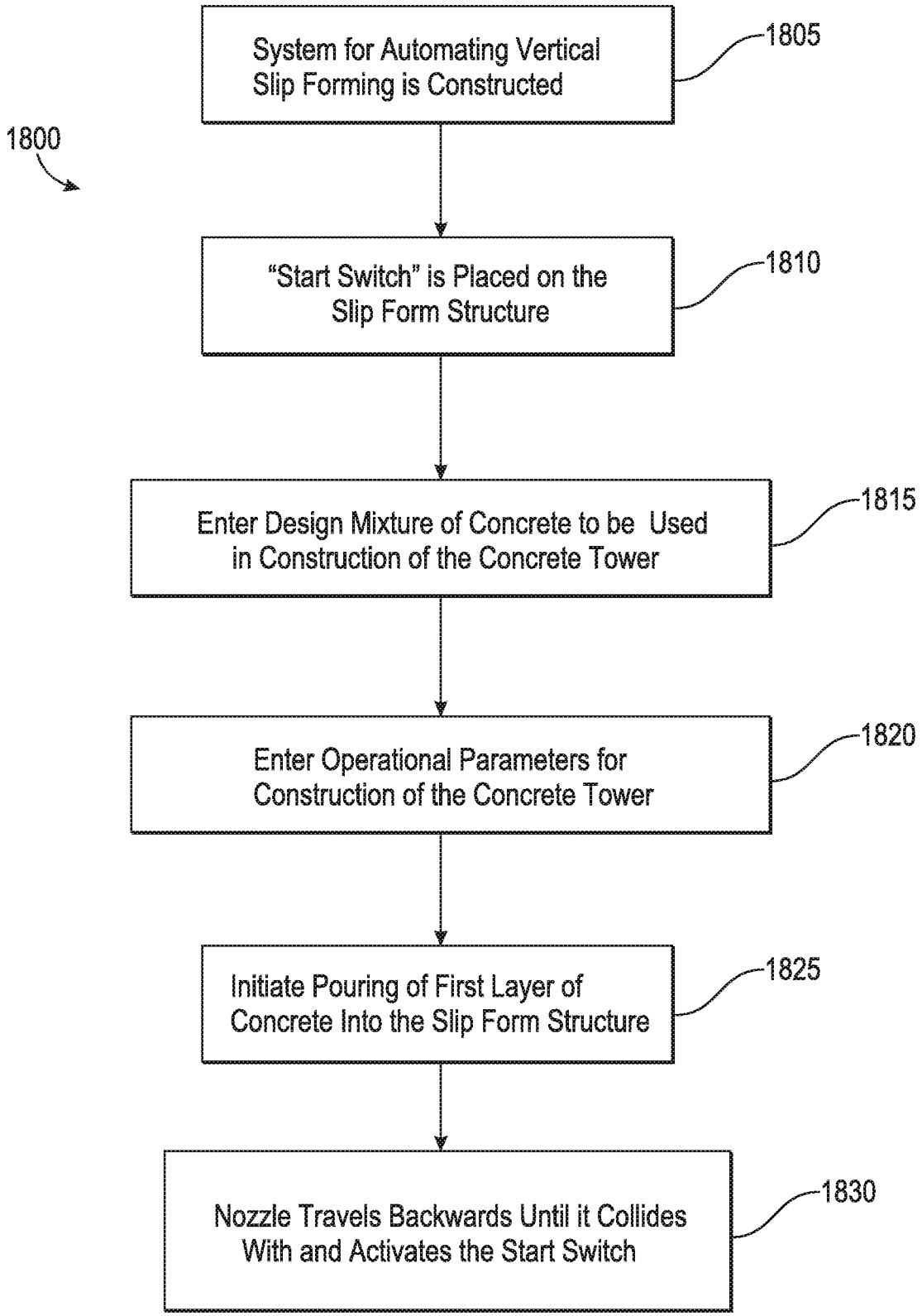
FIGS. 33A, 33B, and 33C present a single flow chart demonstrating steps for controlling movement of the nozzle and the slip form structure in connection with construction of a concrete structure.
Figure 33B:
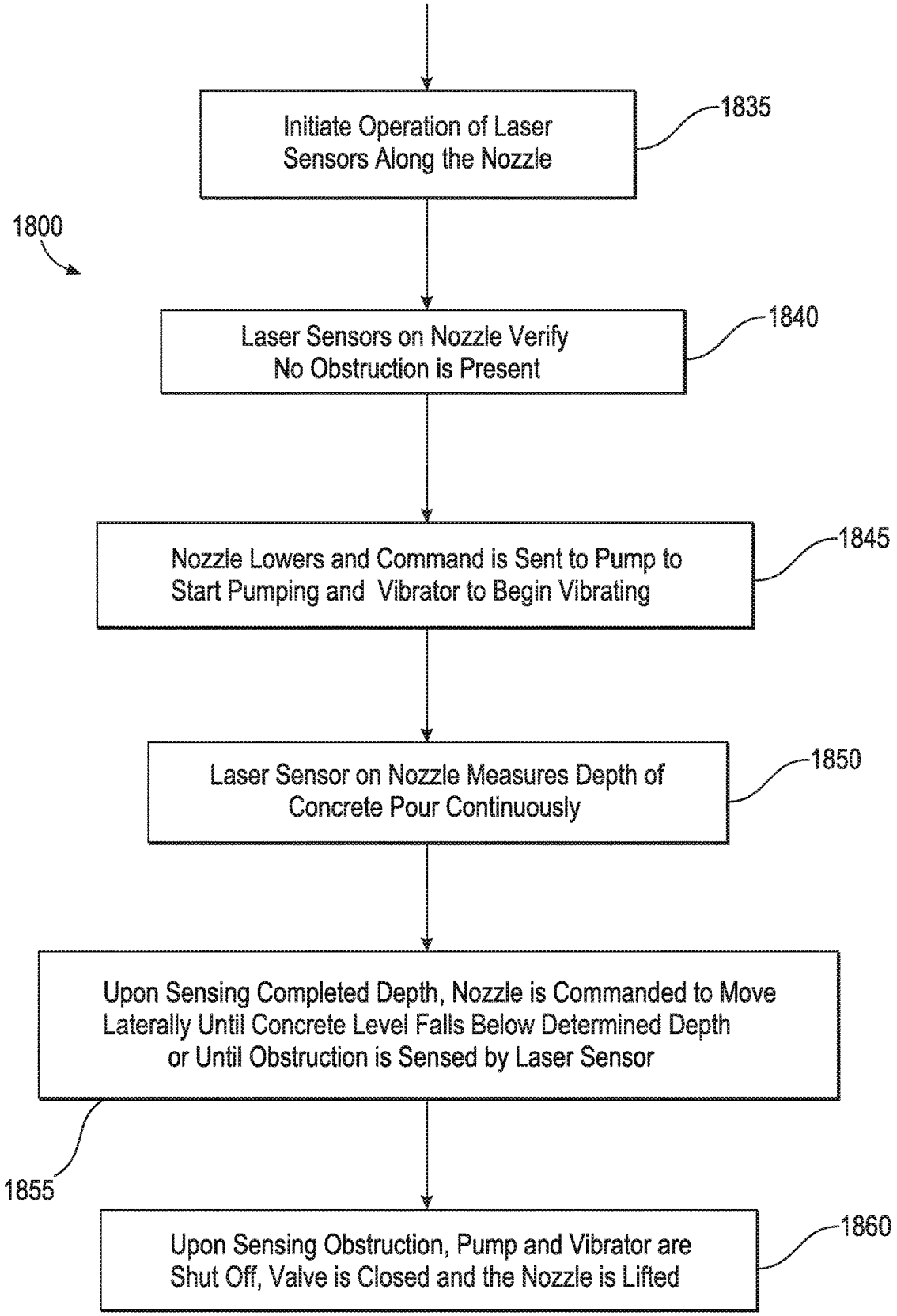
Figure 33C:
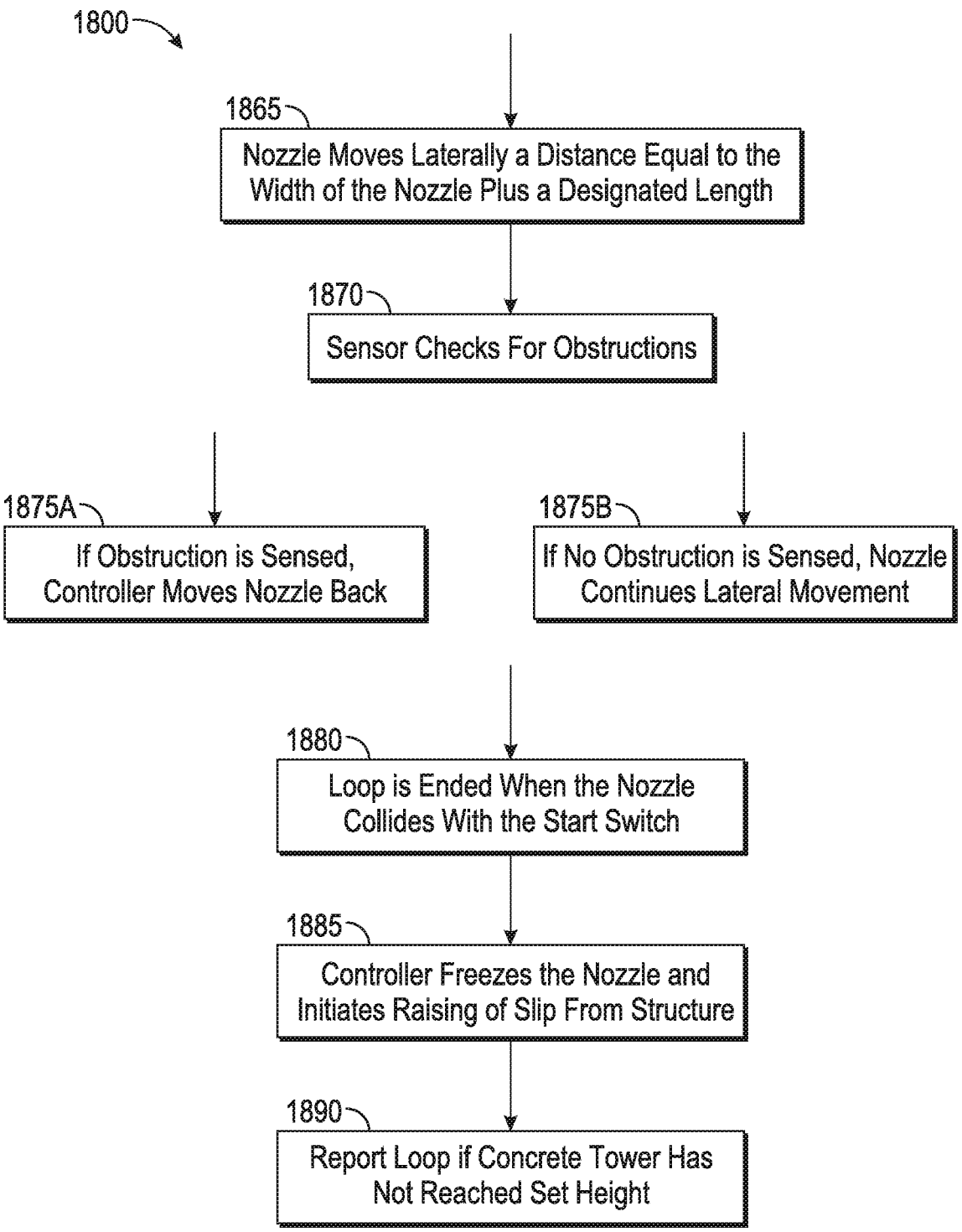

The method 1800 also comprises initiating the pouring of the first layer of concrete into the slip form structure 400. This is shown at Box 1825 of FIG. 33A. The controller will inform the laser sensor(s) along the nozzle 1450 of the desired pour depth for the first layer, and for each additional layer.

The method 1800 further includes initiating movement of the nozzle 1450 back away from the trough of the slip form structure 400. This is seen at Box 1830. As the nozzle 1450 moves backwards, it will collide with the Start switch. This informs the controller that a pour layer is to begin, and begins operation of the pumps and vibrator. It also begins controlled movement of the nozzle 1450 and associated valve.

The method 1800 next involves the activation of location sensors associated with the nozzle 1450 and conduit 1410. This is provided at Box 1835. The sensors send signals to the controller, which in turn moves the nozzle 1450 into the trough and opens the valve.

The method 1800 also comprises verifying that no obstruction is present. This is indicated at Box 1840. This involves the laser sensors along the conduit 1410 checking the immediate surroundings.

The method 1800 also provides lowering the nozzle 1450. At the same time, a command is sent to the pumps to start pumping, and for the vibrator to begin vibrating. This is shown at Box 1845. Wet concrete is now poured into the trough of the slip form structure 400.

The method 1800 additionally includes continuous monitoring of the depth of the concrete pour. This is given at Box 1850. In this step 1850, the laser sensor adjacent the nozzle observes the distance of the concrete layer from the nozzle. As the concrete layer rises, signals are sent back to the controller. When the concrete layer rises to a location a designated distance from the laser sensor, then the system knows that a desired pour depth has been achieved.

The method 1800 next addresses the sensing of obstructions. This is seen at Box 1855. The nozzle 1450 will inevitable approach a section of rebar or other obstacle along the pour path. When this occurs, the pump and vibrator are shut off, the valve is closed, and the nozzle 1450 is lifted out of the trough.

Next, the nozzle 1450 will move laterally along the trough. In one aspect, the nozzle 1450 will move a distance equal to the width of the nozzle 1450, plus a designated distance such as one inch or twelve inches. This is provided at Box 1860. As the nozzle 1450 moves, it will continue to check for obstructions per Box 1865. If an obstruction is sensed, then the nozzle 1450 will be moved back, or moved back farther before moving laterally. This is shown at Box 1875A. In one embodiment, moving the nozzle 1450 back comprises pulling cable 1475.

On the other hand, if no obstructions are encountered, then the nozzle 1450 will continue to fill the trough and to move laterally along the trough during the pour cycle. This is provided at Box 1875B.

The rate of lateral movement of the trough may be pre-set as one of the operating parameters of Box 1820. Alternatively, the rate of lateral movement may be dependent on the rate at which the trough fills during the pour cycle.

The conduit 1410 and connected nozzle 1450 will eventually complete the pour cycle. The loop is ended when the nozzle 1450 collides with the Start switch. This is provided at Box 1880. The controller then freezes the location of the nozzle 1450 and initiates raising of the slip form structure 400 for a next pour cycle. This is noted in Box 1885.

Finally, according to the method 1800, the loop is repeated if the full height of the concrete tower has not been reached. This is provided in Box 1890. In this instance, the loop of method 1800 will begin again at Box 1845.

Accordingly, in one, non-limiting example of use, a user would begin by assembling the system for forming a vertical structure through the incremental pouring of wet concrete by placing base plates 350 on the surface where the vertical, concrete structure will be built. The user would then erect the vertical columns 360 by coupling them to the base plates 350. The work platform 700 may then be coupled to the vertical columns 360. With the work platform 700 in place, any necessary equipment may be placed thereon. Next, the main frame 800 may be coupled to the vertical columns 360. Once assembled, the slip form structure 400 may be coupled to the main frame, such as by using L-angle brackets 347. L-angle brackets 347 are rigid, which means that as the main frame 800 moves along the vertical columns 360, the slip form structure moves therewith. The canopy 1100 may then be coupled to the main frame 800 as well, providing a covered working platform 700 as well as sheltering wet concrete as it is poured. In this configuration, concrete may be manually added to the slip form using standard methods known in the art. However, in one configuration, as described earlier, a conduit 1410 may be coupled to the system, which may further comprise a nozzle 1450 having one or more sensors coupled thereto. A concrete pump, supplying concrete to the nozzle 1450, may be controlled via one or more microcontrollers (or other processors), and may also control movement of a knuckle boom 1470 or other mechanism for moving the nozzle 1450 along the trough formed by the slip form structure 400. In such a scenario, the system described herein is automatically controlled; in other words, the supply of concrete, movement of the nozzle 1450, and movement of the main frame and associated slip form structure may be controlled via electronic signals from one or more microcontrollers, computers, or other processors. This is an improvement over the current art, as it significantly reduces man-power required which increases efficiency and lowers cost as a result. The order of assembly in this example should not be viewed as limiting, and the components may be assembled in any number of configurations. Because the work platform 700 is separate from the main frame, in one embodiment, the work platform may raise and lower independently therefrom. This is beneficial, as it allows workers to retrieve worksite materials, take a break and go to a restroom, or retire for the day, without the need to lower the main frame and associated slip forms, which is also a significant improvement over the prior art. As described earlier, and as shown, vertical columns 360 having geared racks thereon may be used. However, the invention is not so limited, and other methods may be used, such as hydraulics or cable-pulley systems.

As is clear from the above disclosure, the system for forming a vertical structure through the incremental pouring of wet concrete solves several problems in the industry; namely, the need for a system and method of slip forming that does not require framework support rods within the concrete, that may be mechanically raised, and that does not require manual pouring of concrete. Because the system may be automated, the number or workers to operate the system is substantially lowered, while production is increased.

Exemplary embodiments are described above. No element, act, or instruction used in this description should be construed as important, necessary, critical, or essential unless explicitly described as such. Although only a few of the exemplary embodiments have been described in detail herein, those skilled in the art will readily appreciate that many modifications are possible in these exemplary embodiments without materially departing from the novel teachings and advantages herein. Accordingly, all such modifications are intended to be included within the scope of this invention.

What is claimed is:

1. A system for forming a vertical structure through the incremental pouring of wet concrete, the system comprising:

a plurality of vertical columns external to the concrete of the vertical structure;

a slip form structure comprising a pair of opposing walls forming a bottomless trough;

a main frame coupled to the slip form structure, wherein the main frame is supported on, and configured to move vertically along, the vertical columns; and a work platform residing below the slip form structure and main frame, the work platform being supported on, and configured to move vertically along, the vertical columns;

wherein the main frame moves independently of the work platform; and wherein the slip form structure is coupled to the main frame using a series of brackets coupled to flanges of the slip form structure.

2. The system of claim 1, wherein the vertical columns comprise a geared rack and wherein the main frame comprises a plurality of motors having pinions, the pinions configured to engage the geared racks of the vertical columns such that activation of the motors induces the main frame, and slip form structure coupled thereto, to move vertically along the geared vertical columns.

3. The system of claim 2, further comprising work platform motors having pinions, such that the pinions engage the geared vertical columns, wherein activation of the work platform motors induces the work platform to move vertically along the geared vertical columns.

4. The system of claim 3, wherein the main frame and work platform move simultaneously.

5. The system of claim 1, further comprising a plurality of levers extending downwardly from the main frame, wherein a guide wheel is coupled to a distal end of each lever, the guide wheel configured to roll along cured concrete as the main frame raises.

6. The system of claim 1, further comprising a conduit, the conduit having a proximal end and a distal end, wherein the proximal end is configured to be placed in fluid communication with a pump for pumping a concrete slurry, and the distal end is configured to deliver wet concrete slurry to the trough formed by slip form sections.

7. The system of claim 6, further comprising a nozzle at the distal end of the conduit.

8. The system of claim 7, further comprising a distance sensor adjacent to the nozzle, the distance sensor sensing a distance between the sensor and a layer of wet concrete as the wet concrete is poured through the nozzle.

9. The system of claim 8, further comprising a micro-motor residing adjacent the nozzle, wherein the micro-motor is configured to generate vibratory energy while concrete slurry is passing through the nozzle.

10. The system of claim 8, further comprising a processor, wherein the processor is configured to receive commands from the distance sensor and to cause (i) the nozzle to close, or (ii) a pump to discontinue pumping a concrete slurry into the conduit, when the distance sensor senses that a layer of wet concrete within the trough has reached a designated distance from the nozzle.

11. The system of claim 10, further comprising an electronically-controlled arm for moving the conduit, the electronically-controlled arm moveable such that the nozzle remains in the trough formed from slip sections, the movement of the electronically-controlled arm being controlled by one or more motor control signals.

12. The system of claim 11, wherein the motor control signals are generated using a microcontroller.

13. A method of using the system for forming a vertical structure through the incremental pouring of wet concrete of claim 12, comprising the steps of:

filling the trough through a series of successive concrete pours using the nozzle; raising the slip form structure to successive vertical positions as the trough becomes filled with concrete by sliding the slip form structure over partially cured concrete; raising the work platform to a vertical position below the main frame as needed relative to the height of the slip form structure and connected main frame; automatically moving the nozzle in response to readings from the distance sensor located adjacent the nozzle;

(i) adjusting a rate of flow of the concrete slurry through the nozzle in response to sensor readings of rate-of-fill of the trough;

(ii) adjusting a rate of movement of the nozzle along the trough in response to sensor readings of the rate-of-fill of the trough; or (iii) both (i) and (ii); and continuing the above steps to form a concrete tower of a desired overall height.

14. The method of claim 13, wherein the microcontroller is programmed to (i) control a rate at which concrete is poured into the trough in response to depth sensor readings, (ii) close a valve or open a valve associated with the nozzle at the end of the conduit, (iii) move the nozzle along the trough and avoid obstacles, (iv) raise the main frame operatively connected to the slip form structure in response to successive layers of wet concrete being poured, (v) raise the work platform below the main frame, and (vi) combinations thereof.

15. The method of claim 14, further comprising inputting operational parameters to the microcontroller to control movement of the conduit and nozzle, wherein the operational parameters comprise (i) pour layer depth, (ii) ambient temperature, (iii) ambient humidity, (iv) concrete slurry temperature, (v) rate of travel of the nozzle along the trough, (vi) overall height of the concrete structure, (vii) or combinations thereof.

* * * * *